US006371471B1

(12) United States Patent
Fukazu et al.

(10) Patent No.: US 6,371,471 B1
(45) Date of Patent: Apr. 16, 2002

(54) SHEET PROCESSING APPARATUS HAVING A PLURALITY OF PROCESSING UNIT WITH INDEPENDENT POWER SUPPLY

(75) Inventors: Yasuo Fukazu, Chiba; Toshiya Kanazawa; Chikara Sato, both of Tokyo; Norifumi Miyake, Chiba; Masatoshi Yaginuma; Hiromichi Tsujino, both of Ibaraki; Nobuaki Miyahara, Tokyo, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/619,717

(22) Filed: Jul. 19, 2000

(30) Foreign Application Priority Data

Jul. 23, 1999 (JP) ..... 11-209150
Jul. 23, 1999 (JP) ..... 11-209152
Jul. 23, 1999 (JP) ..... 11-209156
Sep. 1, 1999 (JP) ..... 11-247383

(51) Int. Cl.[7] ..... G03G 15/00

(52) U.S. Cl. ..... 270/58.09; 270/58.08; 493/405; 399/407; 399/18; 399/88

(58) Field of Search ..... 270/58.09, 58.08, 270/58.07; 399/407, 408, 411, 7, 16, 18, 88, 90; 271/302, 303; 493/405, 421

(56) References Cited

U.S. PATENT DOCUMENTS 4,167,265 A * 9/1979 Whittenberger ..... 493/421
5,094,379 A * 3/1992 Hoyer et al. ..... 270/58.08 X
5,417,417 A 5/1995 Takehara et al. ..... 271/296
5,447,297 A 9/1995 Murata et al. ..... 270/53
5,449,167 A 9/1995 Takehara et al. ..... 271/296
5,640,232 A 6/1997 Miyake et al. ..... 399/18
5,730,438 A * 3/1998 Webb et al. ..... 270/58.08
5,778,300 A 7/1998 Murakami et al. ..... 399/403
5,809,369 A * 9/1998 Furuya et al. ..... 399/70
5,938,186 A 8/1999 Sato et al. ..... 270/58.11
5,951,000 A 9/1999 Sato et al. ..... 270/58.11
6,227,530 B1 * 5/2001 Namba et al. ..... 270/58.09

FOREIGN PATENT DOCUMENTS

JP 62-189480 * 8/1987
JP 10-265121 10/1998

* cited by examiner

*Primary Examiner*—Christopher P. Ellis
*Assistant Examiner*—Patrick Mackey
(74) *Attorney, Agent, or Firm*—Fitzpatrick, Cella, Harper & Scinto

(57) ABSTRACT

A sheet processing apparatus for processing sheets from an image forming apparatus includes a first processing unit for processing a sheet, the first processing unit including a processing station for processing a sheet, a first path for transporting a sheet therethrough, and a second path for transporting a sheet to the processing station, a second processing unit for processing the sheet transported from the first processing unit, a power supply for supplying power independently to the first processing unit and the second processing unit. The first processing unit selects the first path when the first processing unit is not supplied with power by the power supply.

12 Claims, 27 Drawing Sheets

FIG.8

801

| MECHANICAL CONNECTION | DIP SWITCH 2011 | TRANSISTOR 2022 | LOGIC LEVEL | DISCRIMINATION |
|---|---|---|---|---|
| YES | ON (VALID) | ON | L | UNIT IS ATTACHED. FUNCTION IS VALIDATED. (2301) |
| | | OFF | L | |
| | OFF (INVALID) | ON | L | UNIT IS ATTACHED. FUNCTION IS VALIDATED. (2302) |
| | | OFF | H | UNIT IS ATTACHED. (2303) |
| NO | ON (VALID) | ON | H | UNIT IS DETACHED (2304) |
| | | OFF | | |
| | OFF (INVALID) | ON | | |
| | | OFF | | |

SHEET PROCESSING APPARATUS HAVING A PLURALITY OF PROCESSING UNIT WITH INDEPENDENT POWER SUPPLY

BACKGROUND OF THE INVENTION

1. Field of the Invention

The present invention relates to a sheet processing apparatus having a plurality of processing unit.

2. Description of the Related Art

A conventional sheet processing apparatus is connected to an image forming apparatus which forms an image onto a sheet. The sheet processing apparatus has plural sheet processing units such as a sheet folding unit, a sheet punching unit, an insert sheet feeder unit, a booklet making unit and sheet stapling unit, by which the sheet processing apparatus can vary sheet processing. All such sheet processing units are supplied with power simultaneously, and if one unit malfunctions, all sheet processing units are not supplied with a power until the malfunctioning sheet processing unit is fixed. That is, even though sheet processing units other than the broken sheet processing unit can process a sheet, all sheet processing units do not work.

In view of this problem, Japan patent application publication 10-265121 shows that a broken sheet processing unit is not supplied with power and sheet processing units other than the broken sheet processing unit are supplied with power. This permits the normal sheet processing units to work while the broken sheet processing unit is waiting for fixing.

However, in a case where a broken sheet processing unit has a sheet feed path which selects between transport of a sheet to another sheet processing unit and transport of a sheet to a sheet processing station within the broken sheet processing unit, if the broken sheet processing unit has selected the path to the sheet processing station when the broken sheet processing unit is not supplied with power, the sheet cannot be transported to the normal sheet processing units which remain supplied with power.

SUMMARY OF THE INVENTION

An object of the present invention is to provide sheet processing apparatus which can transport a sheet to an operative sheet processing unit through a malfunctioning sheet processing unit which is not supplied with power.

In one aspect, the present invention provides a sheet processing apparatus for processing sheets from an image forming apparatus comprising a first processing unit for processing a sheet, said first processing unit including a processing station for processing a sheet, a first path for transporting a sheet therethrough, and a second path for transporting a sheet to said processing station, a second processing unit for processing the sheet transported from said first processing unit, a power supply for supplying power independently to said first processing unit and said second processing unit, wherein said first processing unit selects said first path when said first processing unit is not supplied with power by said power supply.

Preferably, in the sheet processing apparatus, said first processing unit includes leading means for leading a sheet to one of said first and second paths alternatively, and said leading means leads a sheet to said first path when said first processing unit is not supplied with the power by said power supplier.

More preferably, in the above sheet processing apparatus, said processing unit includes driving means for driving said leading means to select said second path, wherein said driving means is not supplied with the power when said first processing unit is not supplied with the power by said power supplier.

Also, in the above sheet processing apparatus, said leading means is driven by said driving means so that said leading means selects said second path, wherein said leading means is pulled by elastic means so that said leading means selects said first path.

Also, in the above sheet processing apparatus, said leading means is a flapper, and said driving means is a solenoid, and said elastic means is a spring.

Specifically, the sheet processing apparatus further comprises an invalidation terminal for designating which unit is not supplied with power, wherein said power supply supplies power in accordance with a designation at said invalidation terminal.

More specifically, in the above sheet processing apparatus, said invalidation terminal includes first and second switches corresponding to said first and second processing units respectively, said first and second switches are grounded and are connected to first and second resistors respectively which are connected to a power source, said power supply includes a first voltage detector for detecting a voltage between said first or second switch and its respective resistor, and said power supply supplies power when a voltage detected by said first voltage detector is a predetermined voltage.

Also, the above sheet processing apparatus further comprises a unit attachment detector for detecting an attachment state of said first and second processing units which are detachable from said sheet processing apparatus, wherein said first or second switches is connected to its respective resistor through a connector when said first or second unit is attached, and is disconnected from its respective resistor when said first or second unit is detached, wherein said unit attachment detector includes a second voltage detector for detecting a voltage between said first or second resistor and said connector, wherein said unit attachment detector includes a third switch which is grounded and connected to a third resistor which is connected to a point between said first or second switches and said connector, and wherein said unit attachment detector turns said third switch on and detects the attachment state based on a voltage by detected said second voltage detector.

Also, in the sheet processing apparatus, said first processing unit is comprised by a sheet folder for folding a sheet.

Also, the sheet processing apparatus further comprises a display for displaying an indication when at least one of said first and second processing unit is not supplied with a power.

Also, the sheet processing apparatus further comprises a transmitter for transmitting a notification to a service center when at least one of said first and second processing unit is not supplied with a power.

In another aspect of the invention, the present invention provides a controlling method of a sheet processing apparatus for processing sheets from an image forming apparatus, said sheet processing apparatus including a first processing unit for processing a sheet, said first processing unit including a processing station for processing a sheet, a first path for transporting a sheet therethrough, and a second path for transporting a sheet to said processing station, and a second processing unit for processing the sheet transported from said first processing unit, said controlling method comprising a step for supplying power independently to said first processing unit and said second processing unit, and a step for selecting said first path when said first processing unit is not supplied with power by said power supply.

By virtue of the above invention, even if said first processing unit is not supplied with power by said power supply, a sheet is transported to said second processing unit through said first processing unit. This permits said sheet processing apparatus to use said second processing unit when said first processing unit is not supplied with power even if a sheet must go through said first processing unit.

Other objects and features of the invention will be apparent from the following description and the drawings.

BRIEF DESCRIPTION OF THE DRAWINGS

FIG. 8 shows a function discrimination table.

DESCRIPTION OF THE PREFERRED EMBODIMENTS

Figure 1:
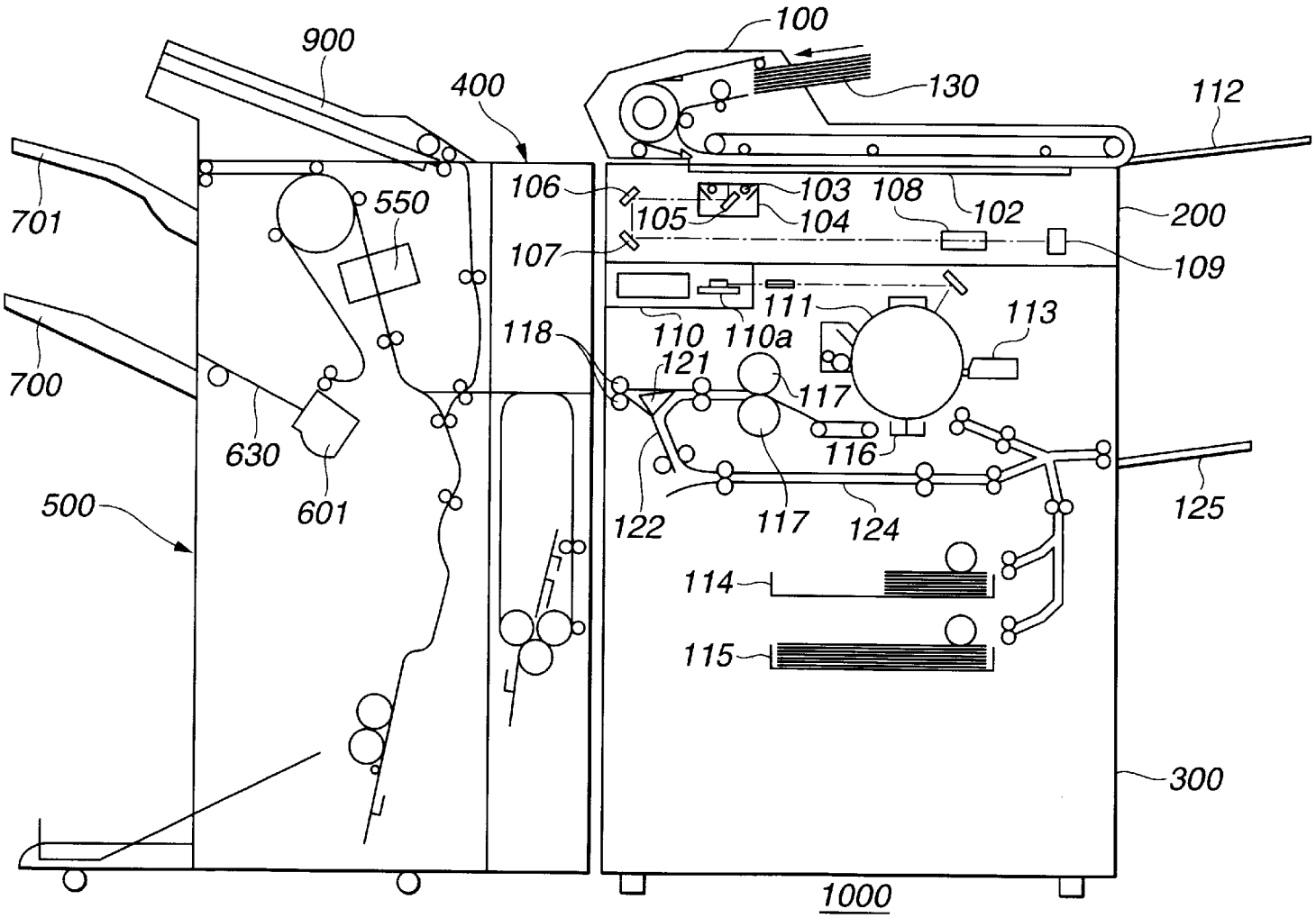
FIG. 1 shows an image forming apparatus.

FIG. 1 shows image forming apparatus 1000 which includes document feeder 100, image reader 200, printer 300, sheet folder 400 and finisher 500. Document feeder 100 feeds original documents set on document tray 130 to plate glass 102 one by one in a page order and discharges the originals to discharge tray 112. Scanner unit 104 scans a document at a predetermined position while the document is transported from left side to right side on plate glass 102 in order to read the document. When a document passes by scanner unit 104, the document is exposed by lamp 103 of scanner unit 104 and the reflected light from the document is led to image sensor 109 through mirrors 105, 106 and 107 and lens 108. Document scanning can also be done by stopping a document on plate glass 102 and moving scanner unit 104 from left to right.

A document image read by image sensor 109 is image processed into an image signal and is sent to exposure controller 110. Exposure controller 110 emits a laser beam in accordance with the image signal. The laser beam is led to photosensitive drum 111. An electrostatic latent image is formed on photosensitive drum 111 in accordance with the laser beam. The electrostatic latent image is visualized by developing unit 113 as a toner image. Meanwhile, a sheet is fed from one of cassettes 114 and 115, manual feed unit 125 and re-feed path 124, in synchronization with the time the laser beam is emitted. The sheet is fed to transfer unit 116. The toner image on photosensitive drum 111 is transferred to the fed sheet by transfer unit 116.

The sheet with the transferred toner image is transported to fixing unit 117. Fixing unit 117 fixes the toner image to the sheet by heat and pressure. The fixed sheet is led to path 122 by flapper 121 and is transported in the opposite direction after the trailing edge of the sheet goes through flapper 121. Then the sheet is discharged out of printer 300 by discharge roller 118 in a face-down state in which the toner image faces downward. This discharge manner is referred to as an inversion discharge.

When sheets are fed from manual feeding unit 125, the inversion discharge is not done, that is, the fixed sheet is discharged in a face-up state. When a two sided copy is done, the fixed sheet is transported to path 122 by flapper 121 after the trailing edge passes by flapper 121 and transported to path 124.

A sheet discharged from discharge roller 118 is transported to sheet folder 400. Sheet folder 400 folds a sheet into a Z shape. When sheet folding is designated by an user and a sheet is A3 size or B4 size, sheet folder 400 conducts sheet folding. Otherwise, sheet folder 400 transports a sheet to finisher 500 without conducting sheet folding. Finisher 500 conducts booklet making, sheet stapling and sheet punching. Insert sheet feeder 900 is provided to finisher 500 and feeds an insert sheet such as a cover sheet to finisher 500.

Figure 2:
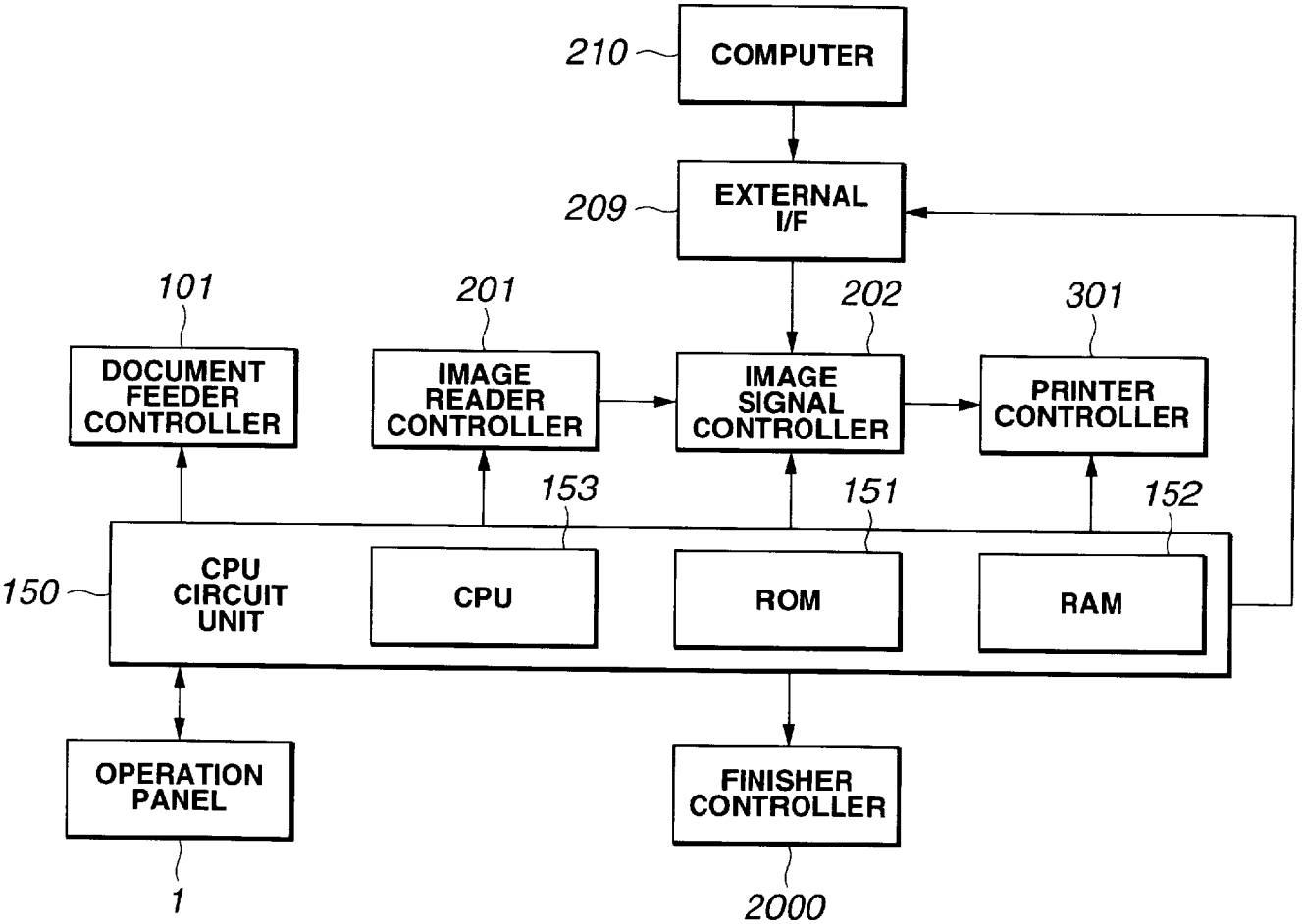
FIG. 2 shows a block diagram of the image forming apparatus of FIG. 1.

FIG. 2 shows a block diagram of image forming apparatus 1000. Image forming apparatus 1000 includes operation panel 1, document feeder controller 101, CPU circuit unit 150, image reader controller 201, image signal controller 202, external I/F 209 connecting an external user's computer 210, printer controller 301 and finisher controller 2000, all controlled in accordance with a program stored in ROM 151 and a designation through operation panel 1. CPU circuit unit 150 includes ROM 151, RAM 152 and CPU 153.

CPU 153 controls document feeder controller 101, image reader controller 201, image signal controller 202, printer controller 301, finisher controller 2000 and external I/F 203. Document feeder controller 101 controls document feeder 100. Image reader controller 201 controls image reader 200. Printer controller 301 controls printer 300. Finisher controller 2000 controls finisher 500 and sheet folder 400.

ROM 151 stores a program and parameters. RAM 152 is used to store control data temporarily and as working area for computing. External I/F 209 is an interface to external computer 210 and converts print data from computer 210 into image data and outputs the image data to image signal controller 202. Image reader controller 201 outputs image data read by image sensor 109 to image signal controller 202. Image signal controller 202 outputs image data to printer controller 301. Printer controller 301 outputs image data to exposure controller 110.

Figure 3:
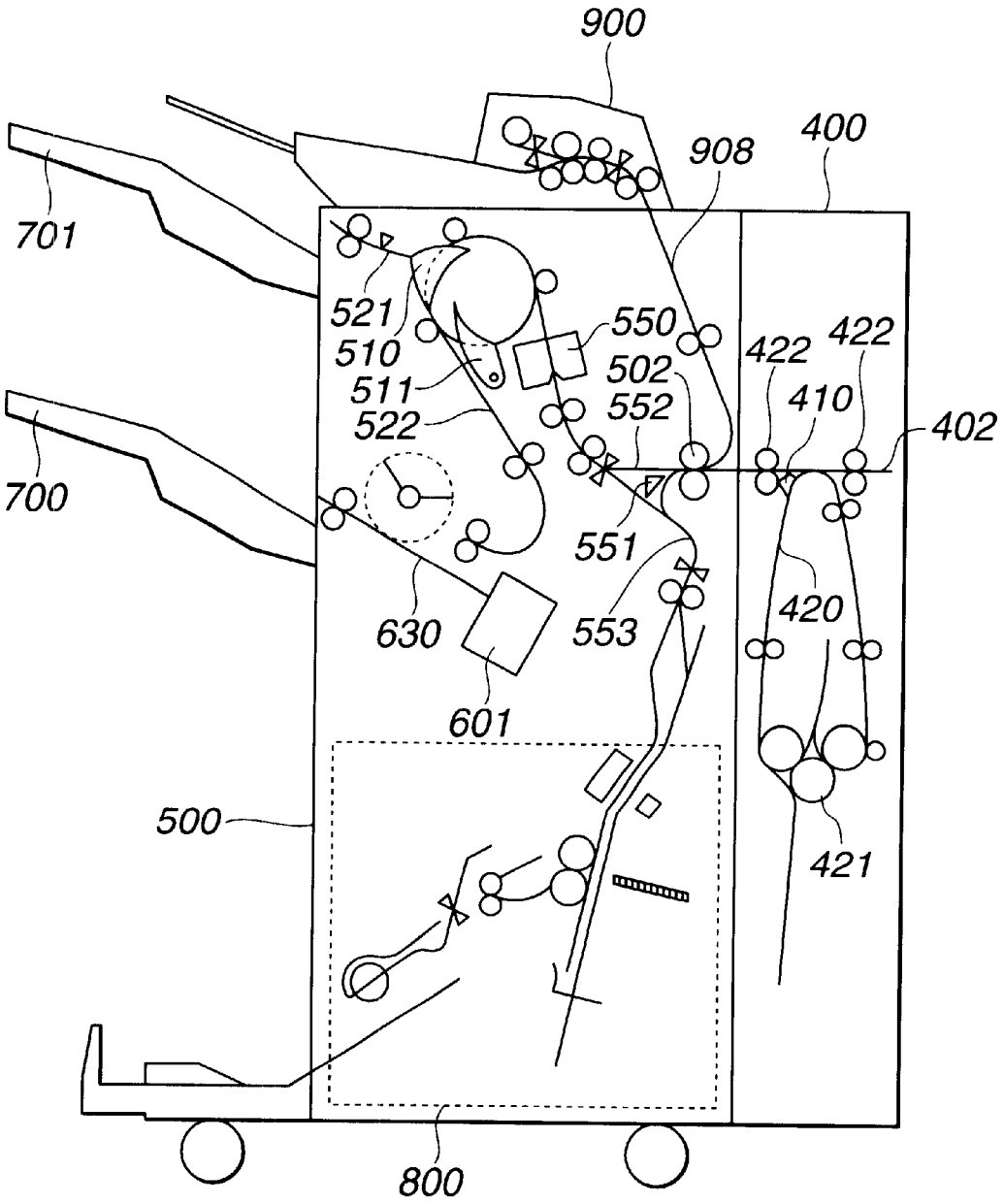
FIG. 3 shows a sheet folder and finisher.

FIG. 3 shows sheet folder 400 and finisher 500. Path 402 receives a sheet from printer 300 and leads the sheet to finisher 500. Flapper 410 leads a sheet to either finisher 500 or path 420. When sheet folding is conducted, flapper 410 leads a sheet to path 420. A sheet led to path 420 is folded in a Z shape by fold roller 421. When sheet folding is not conducted, flapper 410 leads a sheet to finisher 500 through path 402.

In finisher 500, when booklet making is designated, flapper 551 leads a sheet to path 553. Booklet making is conducted to the sheet led to path 553 by booklet making unit 800. Otherwise, flapper 551 leads a sheet to path 552. When sheet punching is designated, sheet punching is conducted by sheet punching unit 550. When sheet punching is not designated, a sheet goes through sheet punching unit 550.

When sheet stapling is designated, flappers 510 and 511 lead a sheet to path 522. The sheet is transported to processing tray 630. Sheets on processing tray are stapled by sheet stapling unit 601 and discharged to stack tray 700. When flapper 510 leads a sheet to path 521, the sheet is discharged to stack tray unit 701. When insert sheet feeding is designated, insert sheet feeder 900 feeds an insert sheet to path 908. The sheet is transported to path 552.

Figure 4:
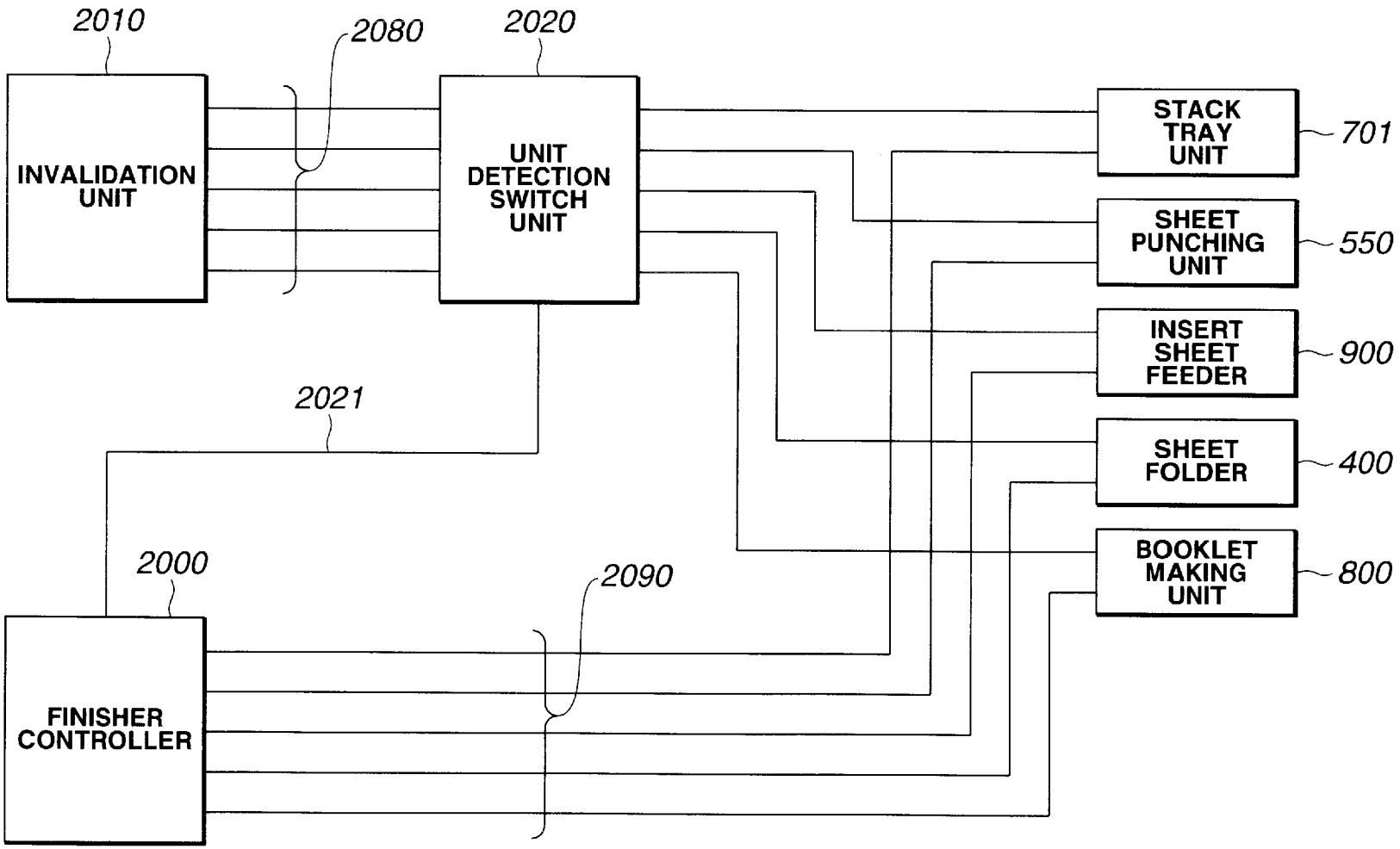
FIG. 4 shows a block diagram for controlling the sheet folder and the finisher.

FIG. 4 shows a block diagram for controlling sheet folder 400 and finisher 500. Finisher controller 2000 includes CPU, ROM, RAM and communication IC. Finisher controller 2000 discriminates if stack tray unit 701, sheet punching unit 550, insert sheet feeder 900, sheet folder 400 and booklet making unit 800 are connected by checking signals from lines 2090.

Invalidation unit 2010 includes dip switches corresponding to stack tray unit 701, sheet punching unit 550, insert sheet feeder 900, sheet folder 400 and booklet making unit 800 in order to invalidate them electrically even though those are connected to finisher 500 mechanically. The dip switches are operated by a user or a service technician. Finisher controller 2000 can check for mechanical connection of each unit to finisher 500 by control over signal 2021 connected to unit detection switch unit 2020, independently of the status of the dip switches of invalidation unit 2010.

Figure 5:
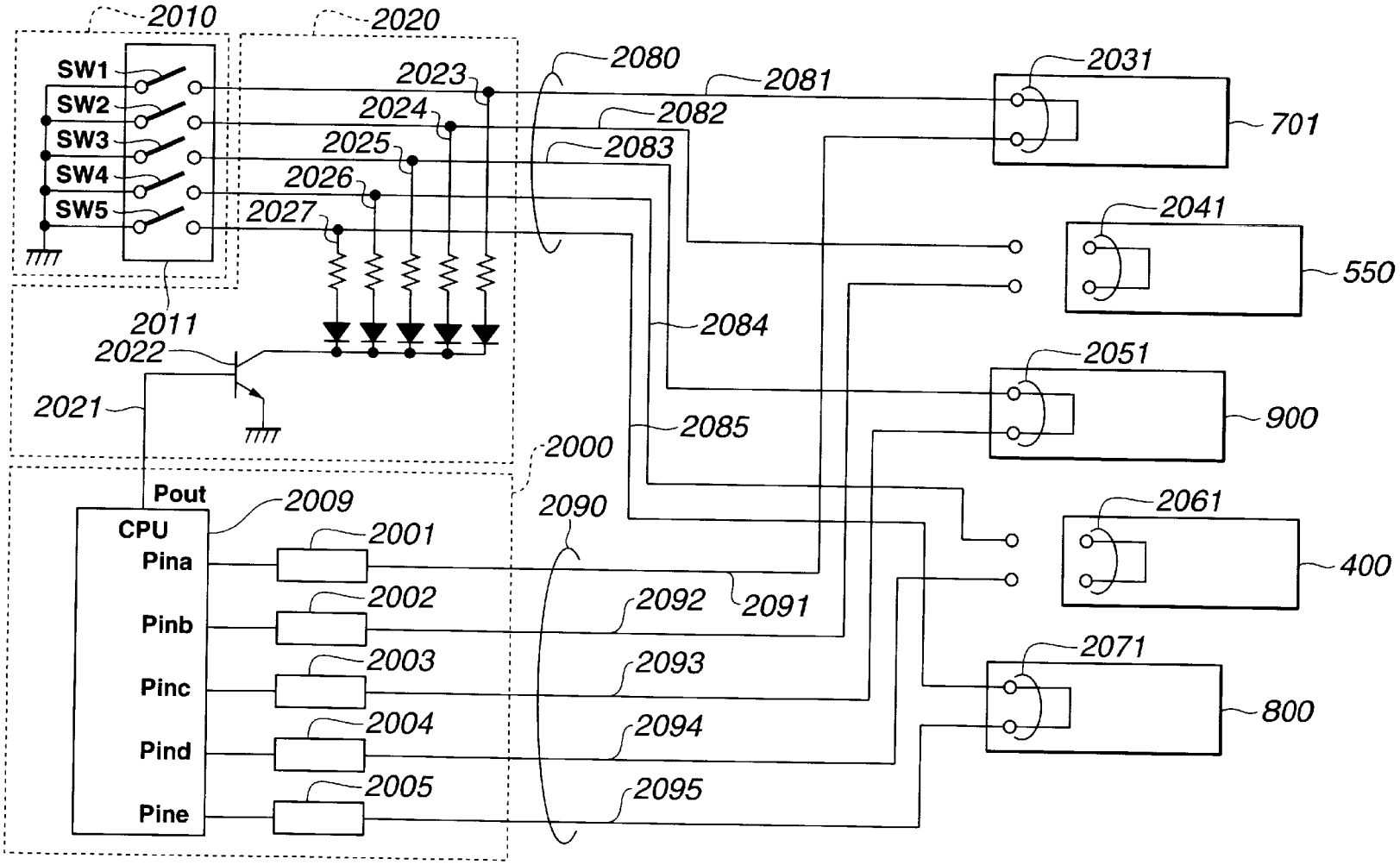
FIG. 5 shows a detailed diagram with respect to an invalidation unit and a unit detection switch unit.

FIG. 5 shows a detailed diagram with respect to invalidation unit 2010 and unit detection switch unit 2020. Invalidation unit 2010 includes dip switches 2011 (SW1–SW5). One terminal of each of the dip switches 2011 is grounded. The other terminal of dip switch SW1 is connected to line 2091 through line 2081 and loop-back line 2031 of stack tray unit 701. Line 2091 is connected to input port Pina of CPU 2009 of finisher controller 2000. Line 2023 is connected to line 2081 in unit detection switch unit 2020. Line 2023 is connected to the collector of transistor 2022. The emitter of transistor 2022 is grounded. The base of transistor 2022 is connected to output port Pout of CPU 2009 of finisher controller 2000.

Likewise, other terminals of the dip switches SW2–SW5 are connected to lines 2092–2095 through lines 2082–2085 and loop-back lines 2032–2035 respectively. Loop-back line 2032 is in sheet punching unit 550. Loop-back line 2033 is in insert sheet feeder 900. Loop-back line 2034 is in sheet folder 400. Loop-back line 2035 is in booklet making unit 800.

Lines 2092–2095 are connected to input ports Pinb-Pine of CPU 2009 of finisher controller 2000 respectively. Lines 2024–2027 are connected to lines 2082–2085 in unit detection switch unit 2020 respectively. Lines 2024–2027 are connected to the collector of transistor 2022.

Figure 6:
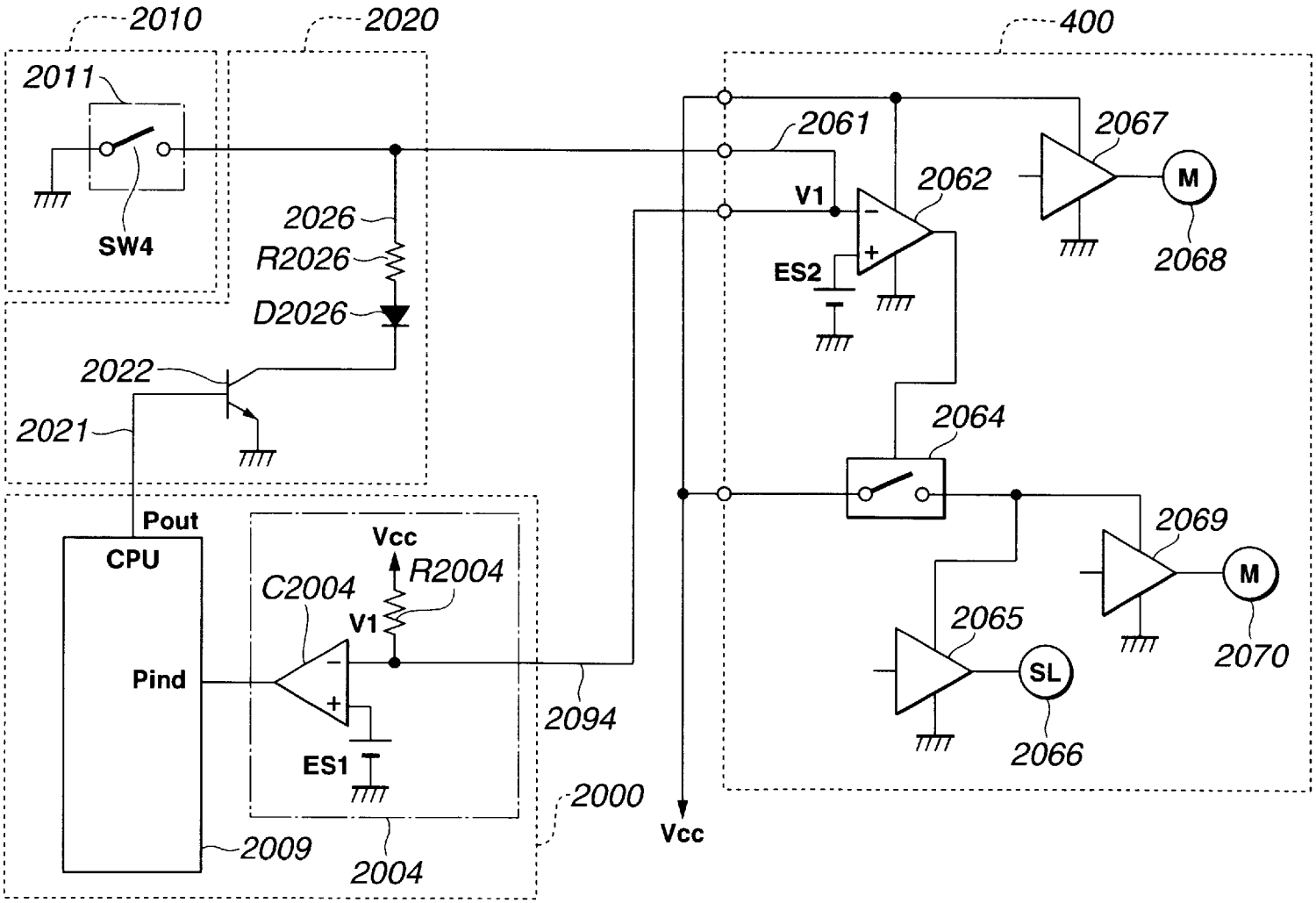
FIG. 6 shows a detailed circuit diagram with respect to the sheet folder of FIG. 4.

FIG. 6 shows a detailed circuit diagram with respect to sheet folder 400. Voltage monitor 2062 monitors voltage V1 of loop-back line 2061 by comparing voltage V1 with reference voltage ES2. Voltage monitor 2062 outputs a signal to power switch 2064 in accordance with the comparison result in order to control whether power is supplied to solenoid driver 2065 and motor driver 2069. Solenoid driver 2065 drives solenoid 2066 which moves flapper 410. Motor driver 2069 drives motor 2070 which rotates rollers 421. When voltage monitor 2062 outputs an ON signal, power switch 2064 supplies power to solenoid driver 2065 and motor driver 2069. When voltage monitor 2062 outputs an OFF signal, power switch 2064 does not supply power to solenoid driver 2065 and motor driver 2069. Power is supplied to motor driver 2067 regardless of power switch 2064. Motor driver 2067 drives motor 2068 which rotates rollers 422.

When dip switch SW4 in invalidation unit 2010 is OFF and transistor 2022 is OFF, voltage V1 on loop-back line 2061 is equal to voltage VH of a power source Vcc. When dip switch SW4 is OFF and transistor 2022 is ON, voltage V1 on loop-back line 2061 is voltage VM. Voltage VM depends on a forward voltage of diode D2026 and a partial voltage between resistor R2004 and resistor R2026. When dip switch SW4 is ON, voltage V1 on loop-back line 2061 is almost equal to ground voltage VL.

Reference voltage ES2 is lower than voltage VM and is higher than voltage VL.

$$VM > ES2 > VL$$

When dip switch SW4 is ON, voltage V1 on loop-back line 2061 is lower than reference voltage ES2 and voltage monitor 2062 outputs an ON signal to power switch 2064 no matter whether transistor 2022 is ON or OFF in order to power on sheet folder 400. When dip switch SW4 is OFF, voltage V1 on loop-back line 2061 is higher than reference voltage ES2 and voltage monitor 2062 outputs OFF signal to power switch 2064 no matter when transistor 2022 is ON or OFF in order to power off sheet folder 400.

Reference voltage ES1 for unit connection detector C2004 is higher than voltage VM and is lower than voltage VH of the power source.

$$VH > ES1 > VM > VL$$

When sheet folder 400 is detached from finisher 500 and transistor 2022 is ON, voltage V1 of line 2061 is voltage VH. When sheet folder 400 is connected to finisher 500 and dip switch SW4 is ON and transistor 2022 is ON, voltage V1 of line 2061 is almost ground voltage VL. When sheet folder 400 is connected to finisher 500 and dip switch SW4 is OFF and transistor 2022 is ON, voltage V1 of line 2061 is voltage VM. That is, voltage V1 is lower than reference ES1 when sheet folder 400 is connected to finisher 500. Voltage V1 is higher than reference ES1 when sheet folder 400 is detached from finisher 500. Therefore, regardless of whether dip switch SW4 is ON or OFF, CPU 2009 of finisher controller 2000 can detect whether sheet folder 400 is connected to finisher 500 by setting transistor 2022 to a high level signal through line 2021.

Basic circuits of stack tray unit 701, sheet punching unit 550, insert sheet feeder 900 and booklet making unit 800 are similar Lo the circuits of sheet folder 400 shown in FIGS. 6.

Figure 7:
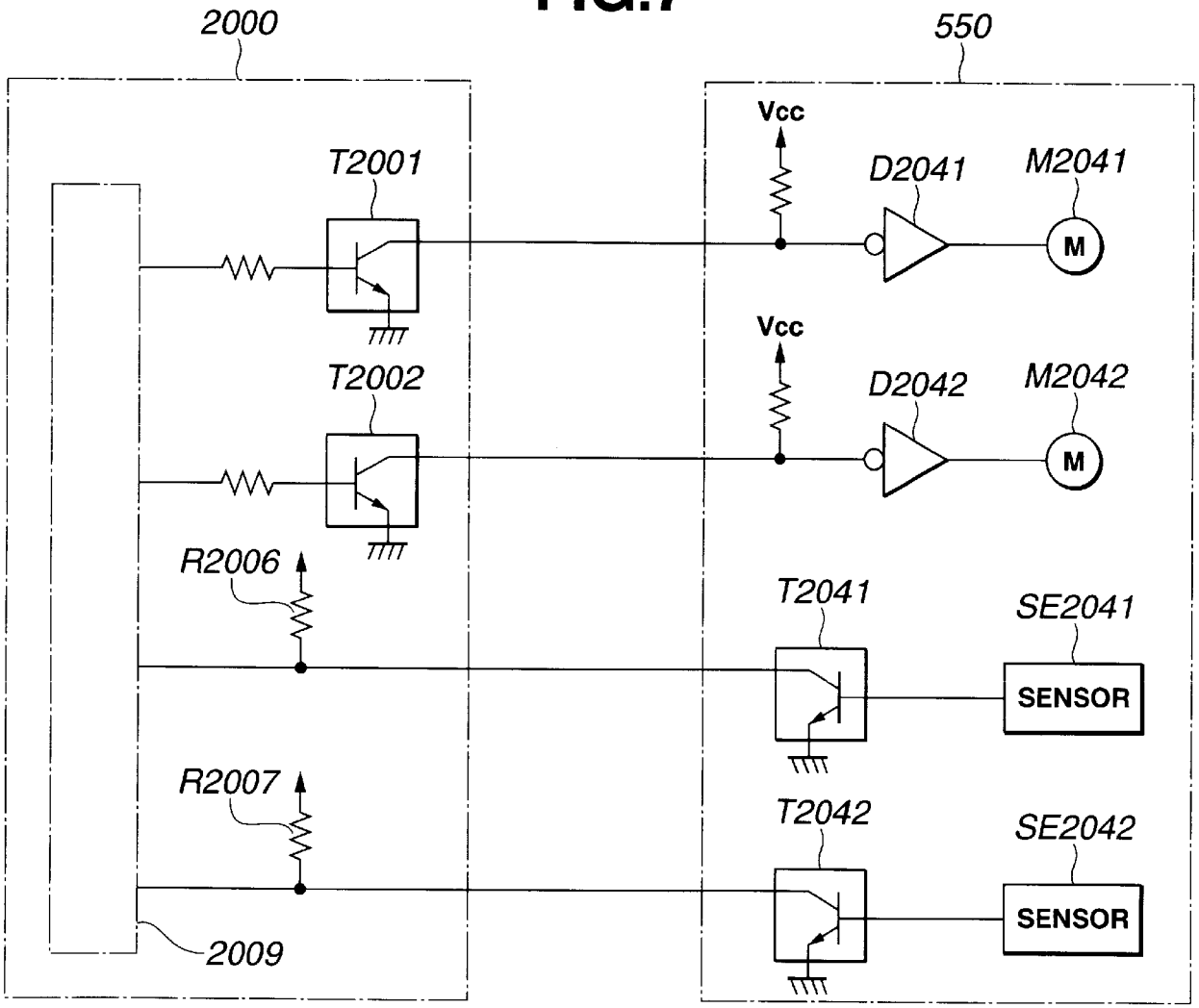
FIG. 7 shows an interface circuit between a finisher controller and a sheet punching unit.

FIG. 7 shows an interface circuit between finisher controller 2000 and sheet punching unit 550. Motor M2041 rotates a puncher of sheet punching unit 550 in order to punch a sheet. Driver D2041 drives motor M2041. A motor ON signal is outputted from output driver T2001 of finisher controller 2000. Motor M2042 moves the puncher of sheet punching unit 550 in a sheet width direction in order to adjust a punching position to a center of sheet. Driver D2042 drives motor M2042. A motor ON signal is outputted from output driver T2002 of finisher controller 2000.

Sensor SE2041 detects if the puncher, which is rotated by motor M2041, is in a home position. Sensor SE2041 outputs a detection result to finisher controller 2000 through output driver T2041. Sensor SF2042 detects if the puncher, which is moved by motor M2042, is in a home position. Sensor SE2042 outputs a detection result to finisher controller 2000 through output driver T2042.

A valid logic between finisher controller 2000 and sheet punching unit 550 is a low level. Thereby, a signal voltage of an output side is not transferred to an input side. Therefore, there is no problem regarding differences of voltages between units regardless of whether a unit is powered on or off.

FIG. 8 shows function discrimination table 801 for discriminating if each unit is attached and if each function is validated with respect to stack tray unit 701, sheet punching unit 550, insert sheet feeder 900, sheet folder 400 and booklet making unit 800. Function discrimination table 801 includes areas 2301–2304.

"Yes" on mechanical connection of function discrimination table 801 means that an unit is connected to finisher 500 mechanically. "No" on the mechanical connection means that an unit is not connected to finisher 500 mechanically. When dip switch 2011 is ON, a function of a unit is validated. When dip switch 2011 is OFF, a function of a unit is invalidated. When line 2021 is a high level, transistor 2022 is ON. When line 2021 is a low level, transistor 2022 is OFF.

CPU 2009 sets output Pout to a low level and reads a logic level of each port Pina-Pine. Referring to the position of the dip switches in FIG. 5, since SW1 of dip switch 2011 is ON and stack tray unit 701 is attached, a low level appears on Pina of CPU 2009. Since SW2 of dip switch 2011 is ON and sheet punching unit 550 is detached, a high level appears on Pinb of CPU 2009. Since SW3 of dip switch 2011 is OFF and insert sheet feeder 900 is attached, a high level appears on Pinc of CPU 2009. Since SW4 of dip switch 2011 is OFF and sheet folder 400 is detached, a high level appears on Pind of CPU 2009. Since SW5 of dip switch 2011 is ON and booklet making unit 800 is attached, a low level appears on Pine of CPU 2009.

Then, CPU 2009 sets output Pout to a high level and reads the logic level of each port Pina-Pine. Since SW1 of dip switch 2011 is ON and stack tray unit 701 is attached, a low level appears on Pina of CPU 2009. Since SW2 of dip switch 2011 is ON and sheet punching unit 550 is detached, a high level appears on Pinb of CPU 2009. Since SW3 of dip switch 2011 is OFF and insert sheet feeder 900 is attached, a low level appears on Pinc of CPU 2009. Since SW4 of dip switch 2011 is OFF and sheet folder 400 is detached, a high level appears on Pind of CPU 2009. Since SW5 of dip switch 2011 is ON and booklet making unit 800 is attached, a low level appears on Pine of CPU 2009.

Then, CPU 2009 discriminates which unit is attached and which function is validated with respect to stack tray unit 701, sheet punching unit 550, insert sheet feeder 900, sheet folder 400 and booklet making unit 800 by reference to function discrimination table 801.

With regard to stack tray unit 701, CPU 2009 discriminates that the unit is attached and the function is validated. With regard to sheet punching unit 550, CPU 2009 discriminates that the unit is detached. With regard to insert sheet feeder 900, CPU 2009 discriminates that the unit is attached and the function is invalidated. With regard to sheet folder 400, CPU 2009 discriminates that the unit is detached. With regard to booklet making unit 800, CPU 2009 discriminates that the unit is attached and the function is validated.

Figure 9A:
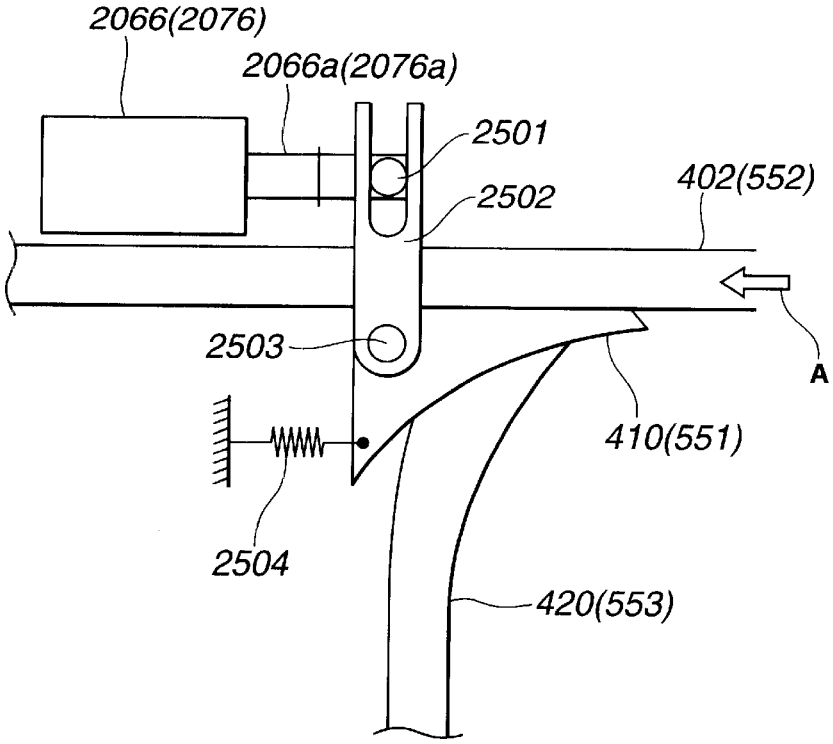
FIGS. 9A and 9B show a flapper for selecting a sheet transportation path in the sheet folder and a flapper for selecting a sheet transport path in the finisher.
Figure 9B:
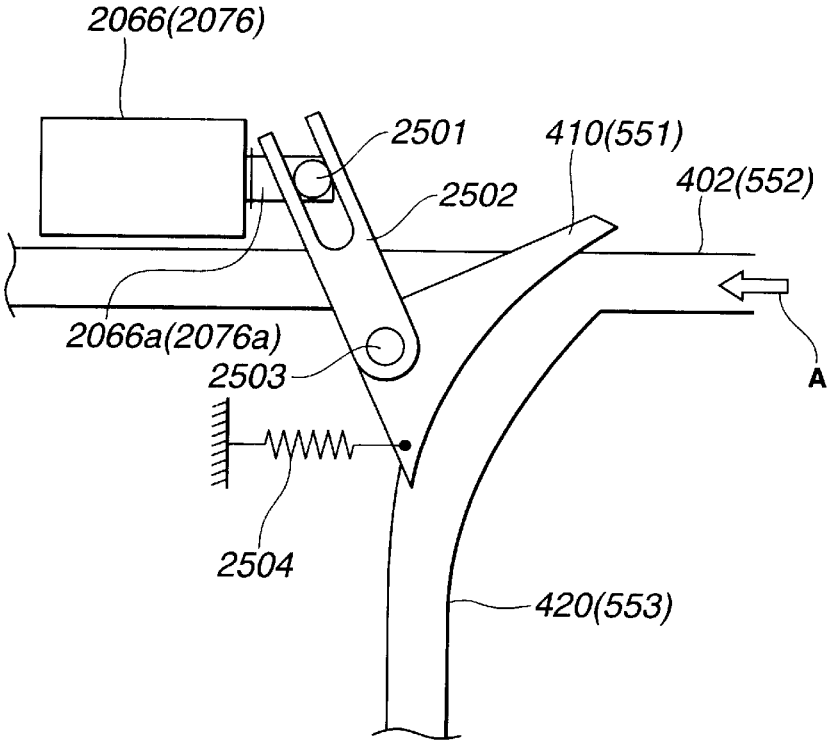

FIGS. 9A and 9B show flapper 410 of sheet folder 400 and flapper 551 of finisher 500. Flapper 410 of sheet folder 400 is described hereinafter. When flapper 410 is in the state shown in FIG. 9A, a sheet is transported along path 402. When flapper 410 is in the state shown in FIG. 9B, a sheet is transported to path 420. Flapper 410 is moved by solenoid 2066 which is driven by solenoid driver 2065 shown in FIG. 6.

Flapper 410 has arm 2502 and rotates on axis 2503. Shaft 2066*a* of solenoid 2066 is linked by shaft 2501. Flapper 410 is rotated by back-and-forth motion of shaft 2066*a*. Flapper 410 is pulled by spring 2504. When solenoid 2066 is activated, shaft 2066*a* is pulled by solenoid 2066 and flapper 410 is in the state shown in FIG. 9B. When solenoid 2066 is not activated, shaft 2066*a* is pulled by spring 2504 and flapper 410 is in the state shown in FIG. 9A. When power is not supplied to solenoid driver 2065, flapper 410 is in the state shown in FIG. 9A and a sheet is transported to finisher 500 along path 402. When dip switch SW4 is OFF, power is not supplied to solenoid 2066 and motor 2070, and flapper 410 leads a sheet to finisher 500. When sheet folder 400 is out of order, dip switch SW4 is set OFF. Thereby, a power is not supplied to sheet folder 400 except for motor driver 2067, and flapper 410 is in a state where a sheet is led to finisher 500.

Instead of solenoid 2066, a motor may be provided for driving flapper 410. Instead of flapper 410, a short path, which is connected to the upperstream part of path 402 and is movable between path 420 and the downstream part of path 402, may be provided for leading a sheet to either path 420 or the downstream part of path 402. The short path may be driven by either a solenoid or a motor. Instead of spring 2504 which is an extension spring, other elastic means such as a compression spring, a blade spring and a rubber band may be provided.

Flapper 551 of finisher 500 has the same structure as flapper 410. Reference numbers regarding flapper 551 are enclosed within parentheses.

Figure 10:
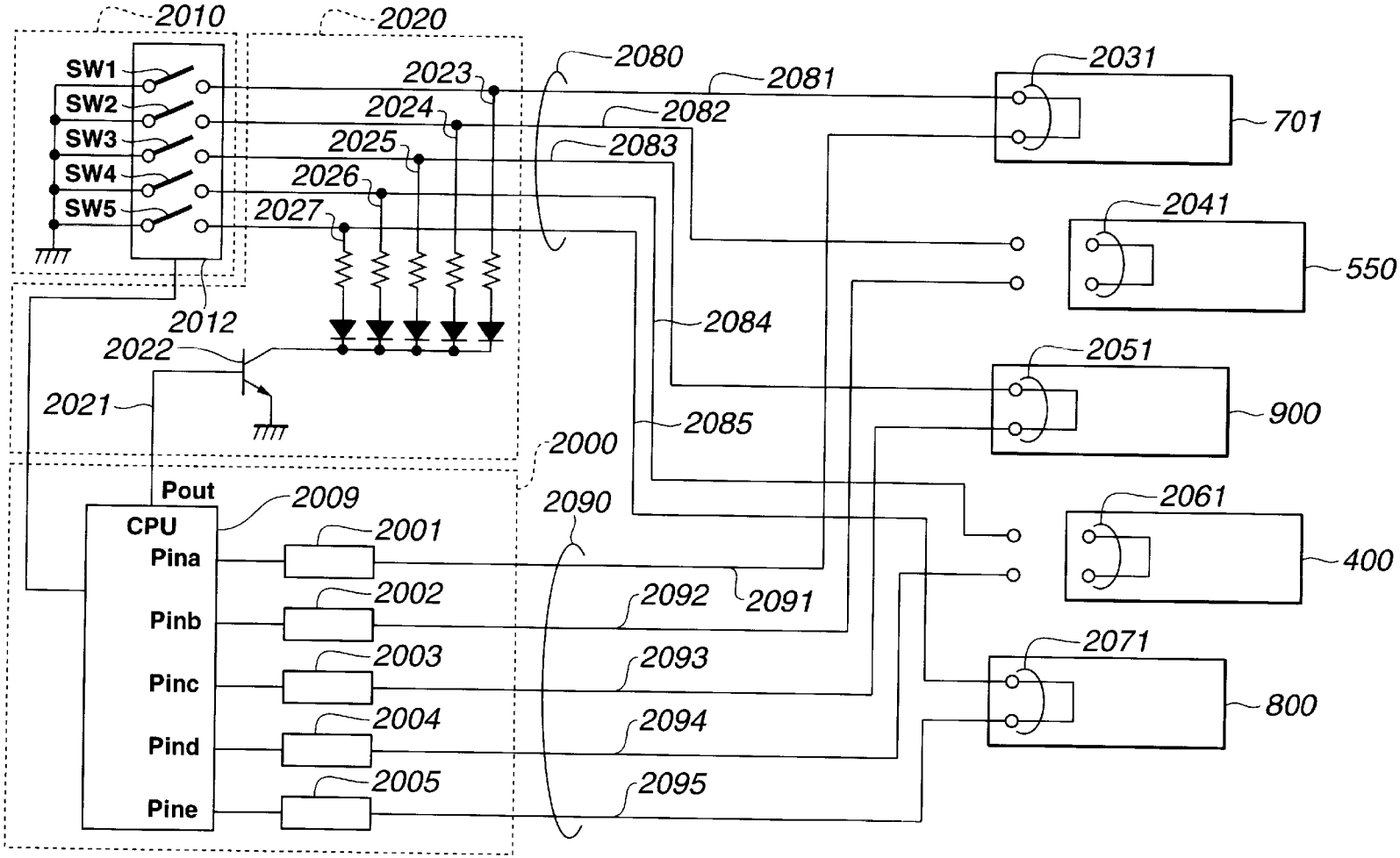
FIG. 10 shows a detailed diagram with respect the to invalidation unit and the unit detection switch unit in another embodiment.

FIG. 10 shows a detailed diagram with respect to invalidation unit 2010 and unit detection switch unit 2020 in another embodiment. One difference between FIG. 10 and FIG. 5 is that switches 2012 are controlled by CPU 2009 and are included instead of dip switches 2011.

Figure 11:
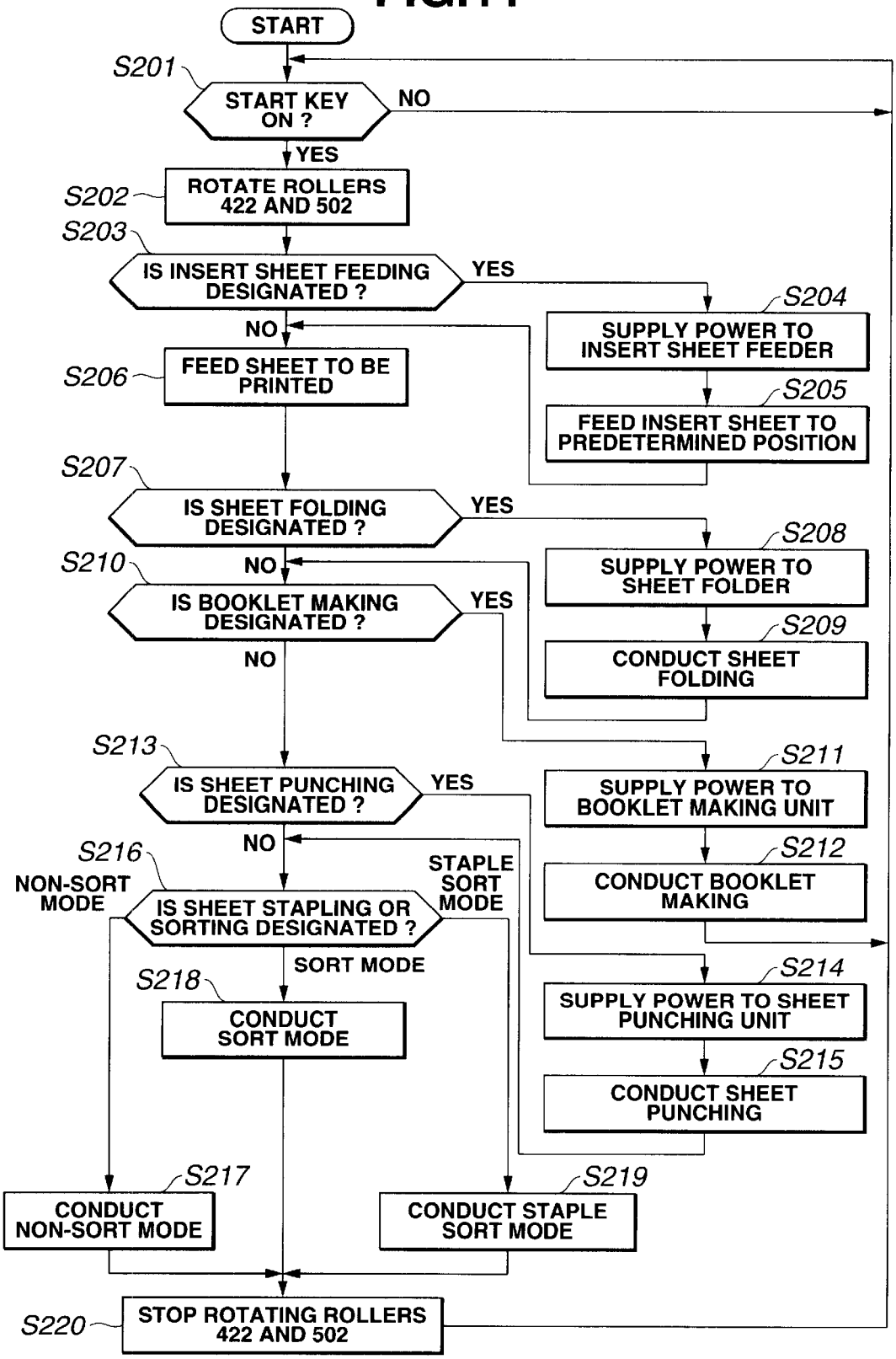
FIG. 11 shows a flowchart for controlling the finisher and the sheet folder.

FIG. 11 shows a flowchart for controlling finisher 500 and sheet folder 400. A program for executing this flowchart is stored in ROM of finisher controller 2000 and executed by CPU 2009.

CPU 2009 discriminates if a start key of operation panel 1 is pressed (S201). If the start key is pressed, CPU 2009 instructs sheet folder 400 to rotate rollers 422 and instructs finisher 500 to rotate roller 502 (S202).

CPU 2009 discriminates if insert sheet feeding is designated by operation panel 1 (S203). If insert sheet feeding is designated, CPU 2009 sets SW3 of switches 2012 ON in order to supply power to insert sheet feeder 900 (S204). Then, CPU 2009 instructs insert sheet feeder 900 to feed an insert sheet to a predetermined position which is located just before roller 502 (S205).

After step S205 or if insert sheet feeding is not designated at step S203, CPU 2009 requests CPU circuit unit 150 to feed a sheet on which an image is to be printed (S206). Then, CPU 2009 discriminates if sheet folding is designated by operation panel 1 (S207). If sheet folding is designated, CPU 2009 sets SW4 of switches 2012 ON in order to supply a power to sheet folder 400 (S208). Then, CPU 2009 instructs sheet folder 400 to conduct sheet folding (S209).

After step S209 or if sheet folding is not designated at step S207, CPU 2009 discriminates if booklet making is designated by operation panel 1 (S210). If booklet making is designated, CPU 2009 sets SW5 ON in order to supply power to booklet making unit 800 (S211). Then, CPU 2009 instructs booklet making unit 800 to conduct booklet making (S212) and returns to step S201.

If booklet making is not designated at step S210, CPU 2009 discriminates if sheet punching is designated by operation panel 1 (S213). If sheet punching is designated, CPU 2009 sets SW2 ON in order to supply power to sheet punching unit 550 (S214). Then, CPU 2009 instructs sheet punching unit 550 to conduct sheet punching (S215).

After step S215 or if sheet punching is not designated at step S213, CPU 2009 discriminates a sort mode (S216). If a nonsort mode is designated at step S216, CPU 2009 instructs finisher 500 to conduct nonsort mode (S217). Then, CPU 2009 instructs sheet folder 400 to stop rotating rollers 422 and instructs finisher 500 to stop rotating roller 502 and sets SW1–SW5 OFF in order to stop supplying power to stack tray unit 701, sheet punching unit 550, insert sheet feeder 900, sheet folder 400 and booklet making unit 800 (S220).

If a sort mode is designated at step S216, CPU 2009 instructs finisher 500 to conduct sort mode (S218) and proceeds to step S220. If staple sort mode is designated at step S216, CPU 2009 instructs finisher 500 to conduct staple sort mode (S219) and proceeds to step S220. After step S220, CPU 2009 returns to step S201.

Since power is supplied to the unit corresponding to the function only when a function is needed, it can minimize power consumption during a waiting state.

Figure 12:
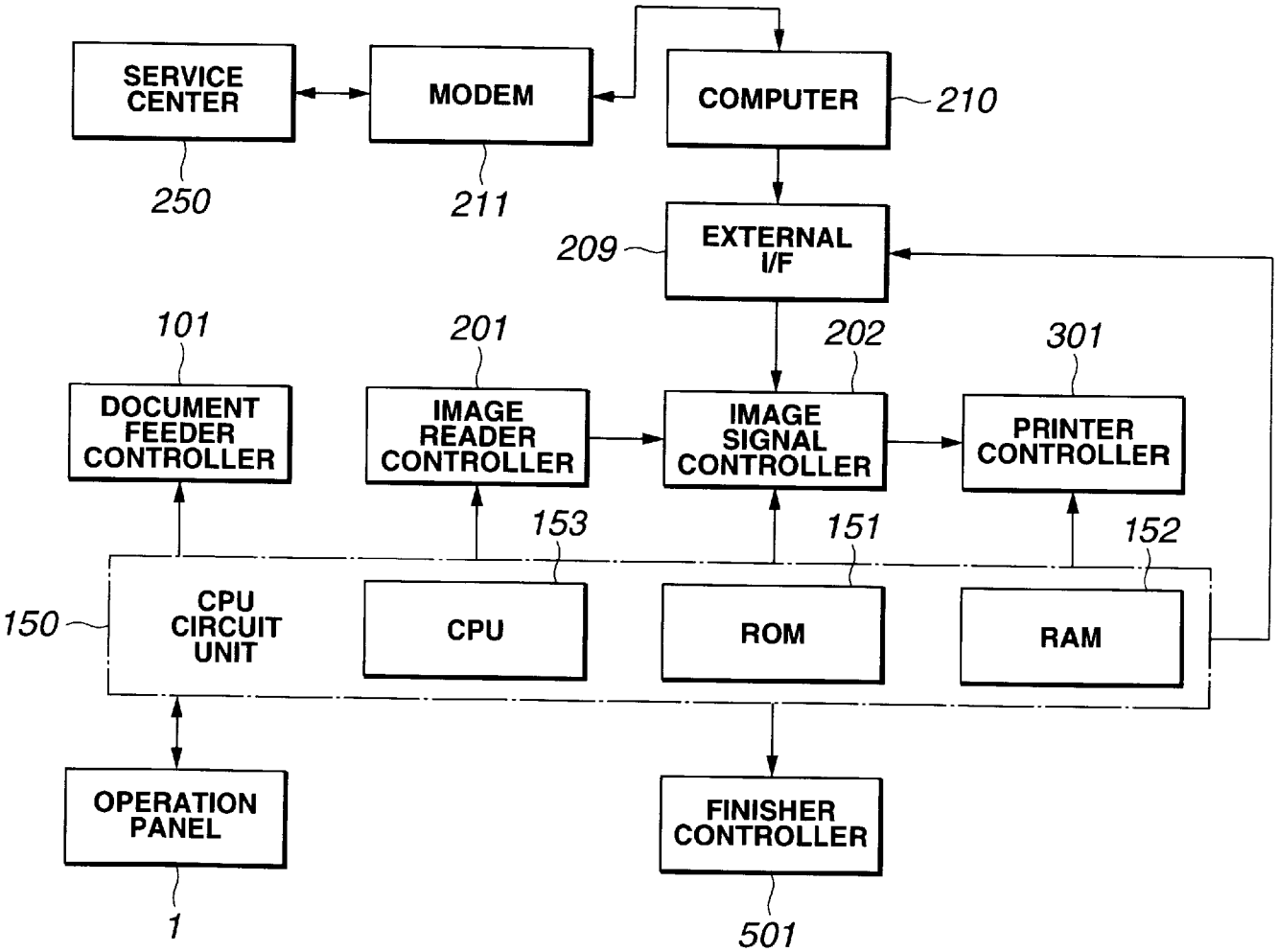
FIG. 12 shows a block diagram of an image forming apparatus in a third embodiment.

FIG. 12 shows a block diagram of image forming apparatus 1000 in third embodiment. The difference between FIGS. 12 and 2 is that service center 250 is connected to computer 210 through modem 211, or other means such as the Internet. Computer 210 transmits data to service center 250 through modem 211 and receives data from service center 250 through modem 211.

Finisher controller 2000 discriminates which unit is attached and which function is invalidated with respect to stack tray unit 701, sheet punching unit 550, insert sheet feeder 900, sheet folder 400 and booklet making unit 800 as described above. Finisher controller 2000 transmits the discrimination result to CPU circuit unit 150. CPU circuit unit 150 instructs operation panel 1 to display the discrimination result or the state of finisher 500 in accordance with a program stored in ROM 151.

Figure 13:
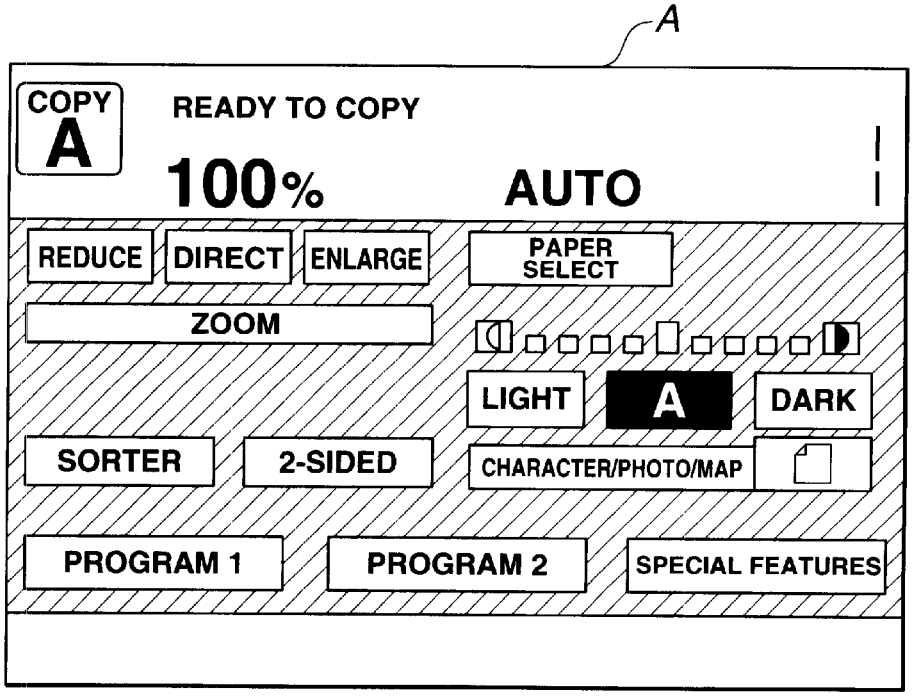
FIG. 13 shows a display screen when no function is invalidated.
Figure 14:
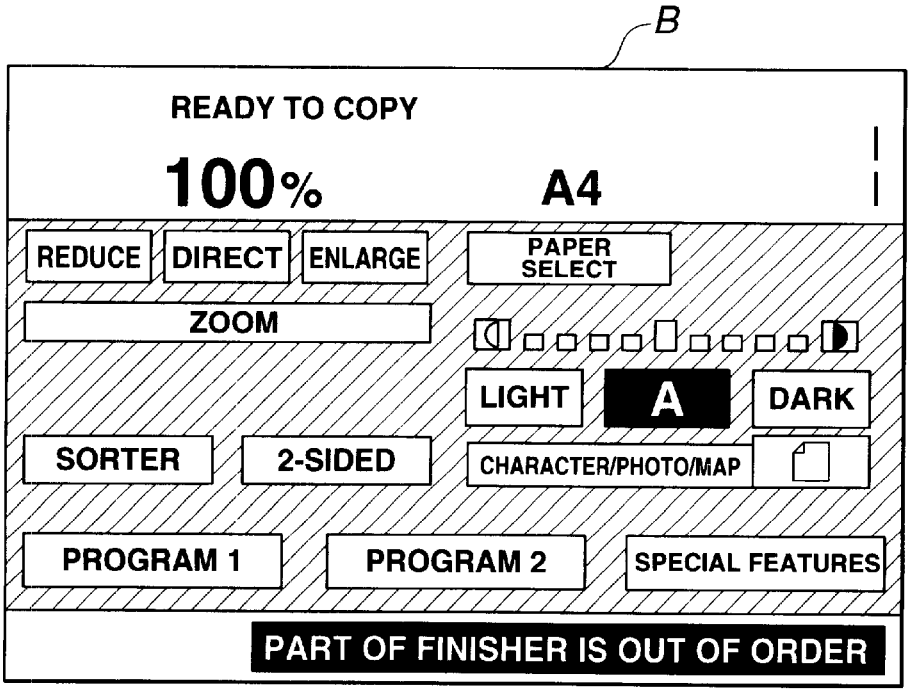
FIG. 14 shows a display screen when some functions are invalidated.

FIGS. 13 and 14 show display screens of operation panel 1 in a ready state. A display of operation panel 1 is a touch panel display. FIG. 13 shows a display screen when no function is invalidated. FIG. 14 shows a display screen when one function is invalidated. As shown in the display of FIG. 14, "Part of finisher is out of order", which means finisher 500 is out of order, is displayed at the bottom of the display screen of operation panel 1.

Figure 15:
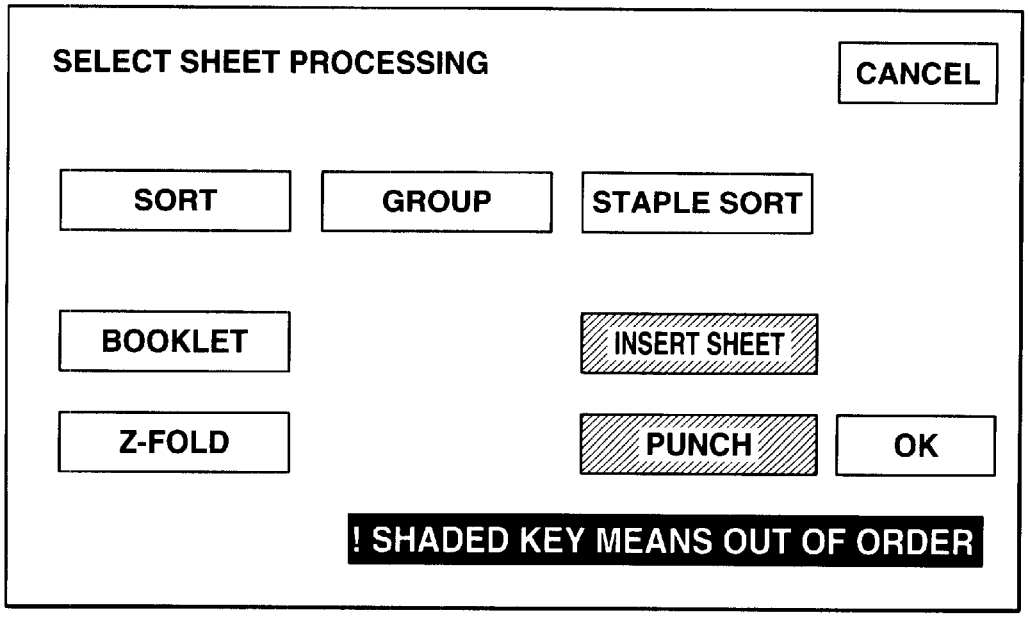
FIGS. 15 to 17 show display screens for selecting sheet processing.
Figure 16:
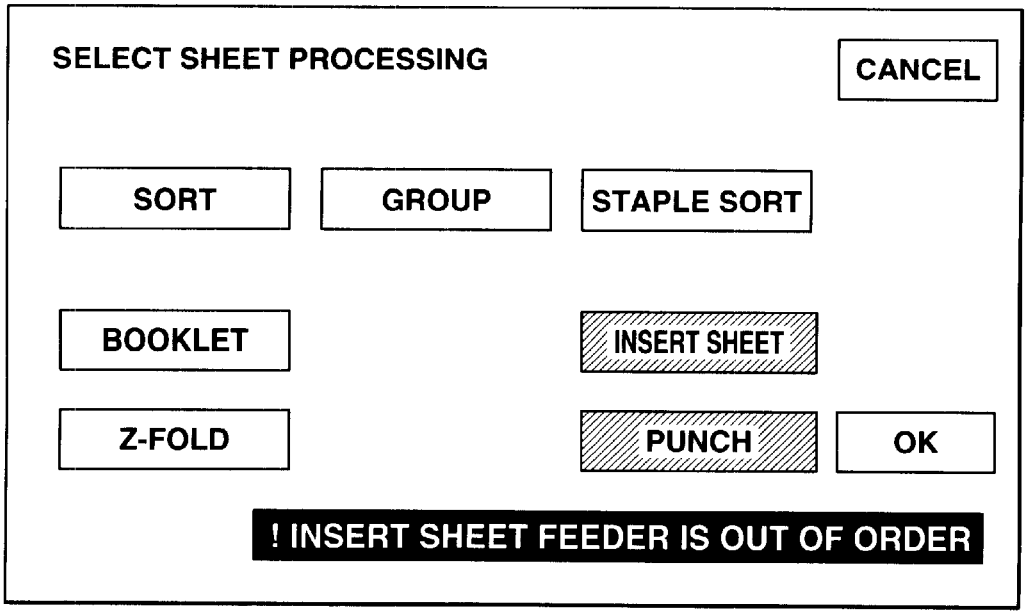
Figure 17:
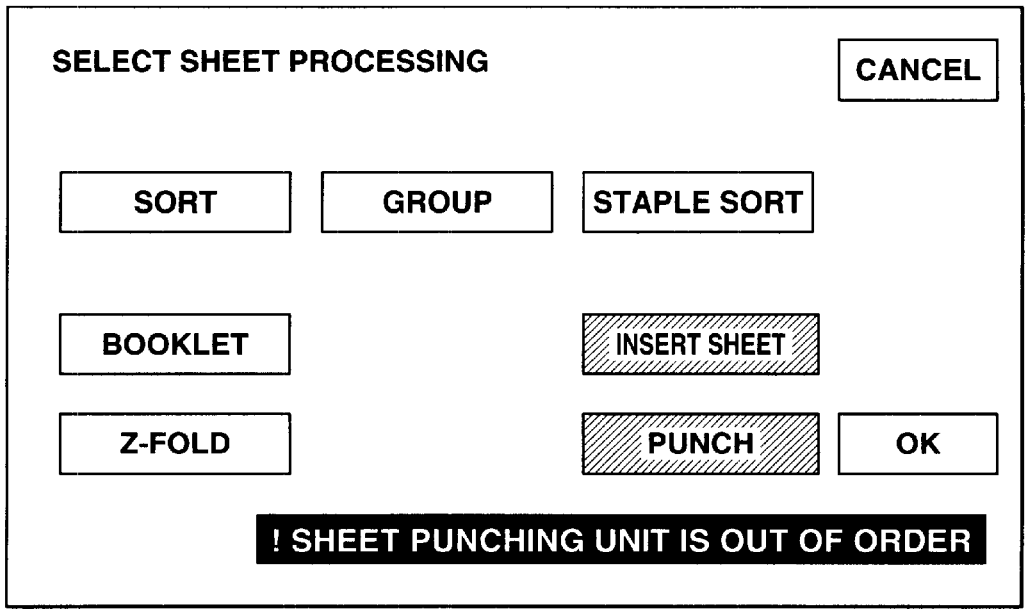

FIG. 15 shows a display screen for selecting sheet processing. The display screen is displayed in a case where the sorter key of the display screen is touched when the display screen shown in FIG. 14 is displayed. The insert sheet feeding select key and sheet punching select key are shaded in order to instruct that the functions for insert sheet feeding and sheet punching are invalidated, that is, the insert sheet feeding function and the sheet punching function are out of order. FIG. 16 shows a display screen in a case where the insert sheet feeding select key is touched when the display screen shown in FIG. 15 is displayed. FIG. 17 shows a display screen in a case where the sheet punching select key is touched when the display screen shown in FIG. 15 is displayed.

CPU circuit unit 150 transmits the attachment information and the invalidation information, which are received from finisher controller 2000, to computer 210 through external I/F 209. The attachment information and the invalidation information are displayed on a monitor of computer 210.

Figure 18:
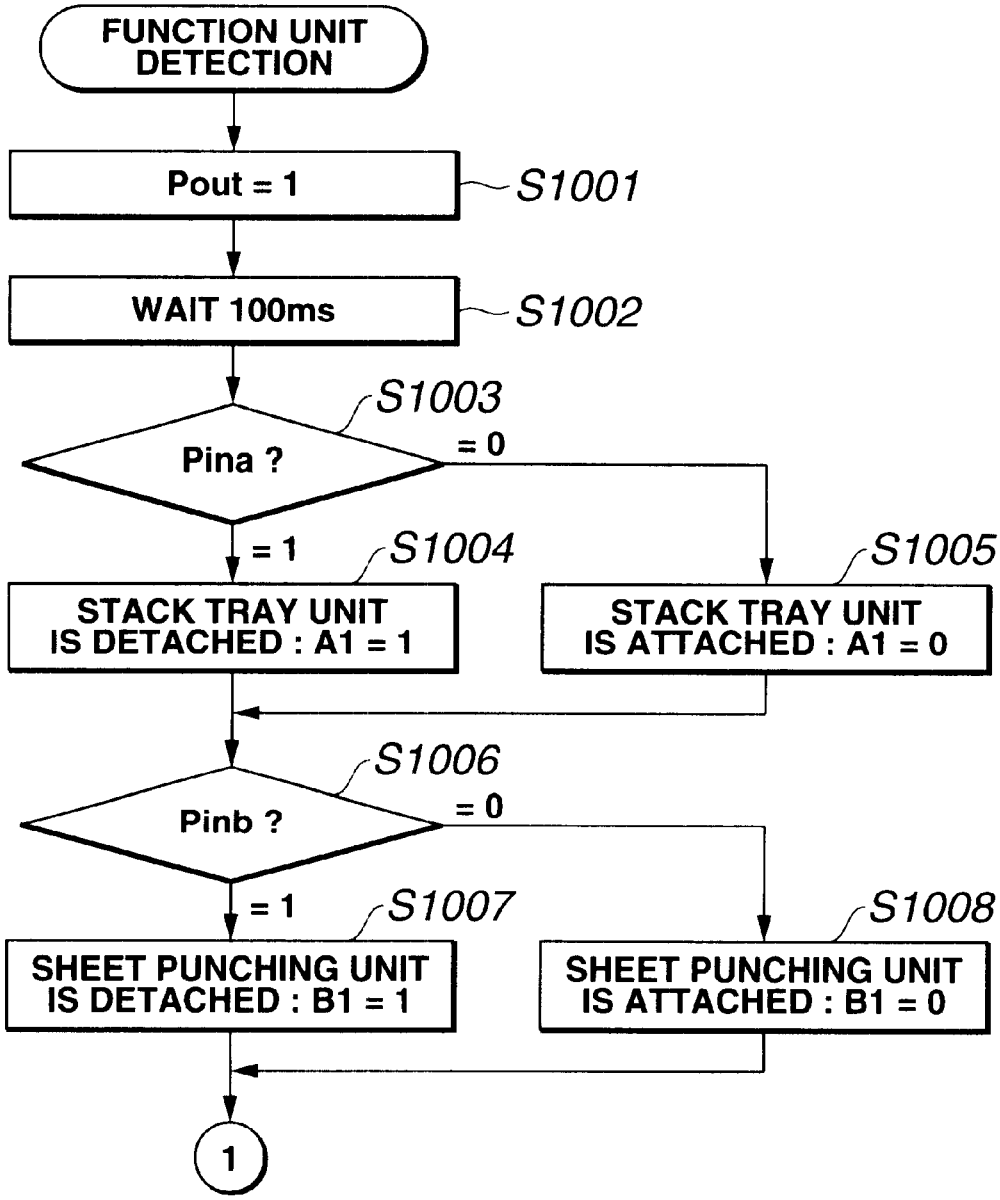
FIGS. 18 and 19 show a flowchart for detecting if each unit is attached to the finisher.
Figure 19:
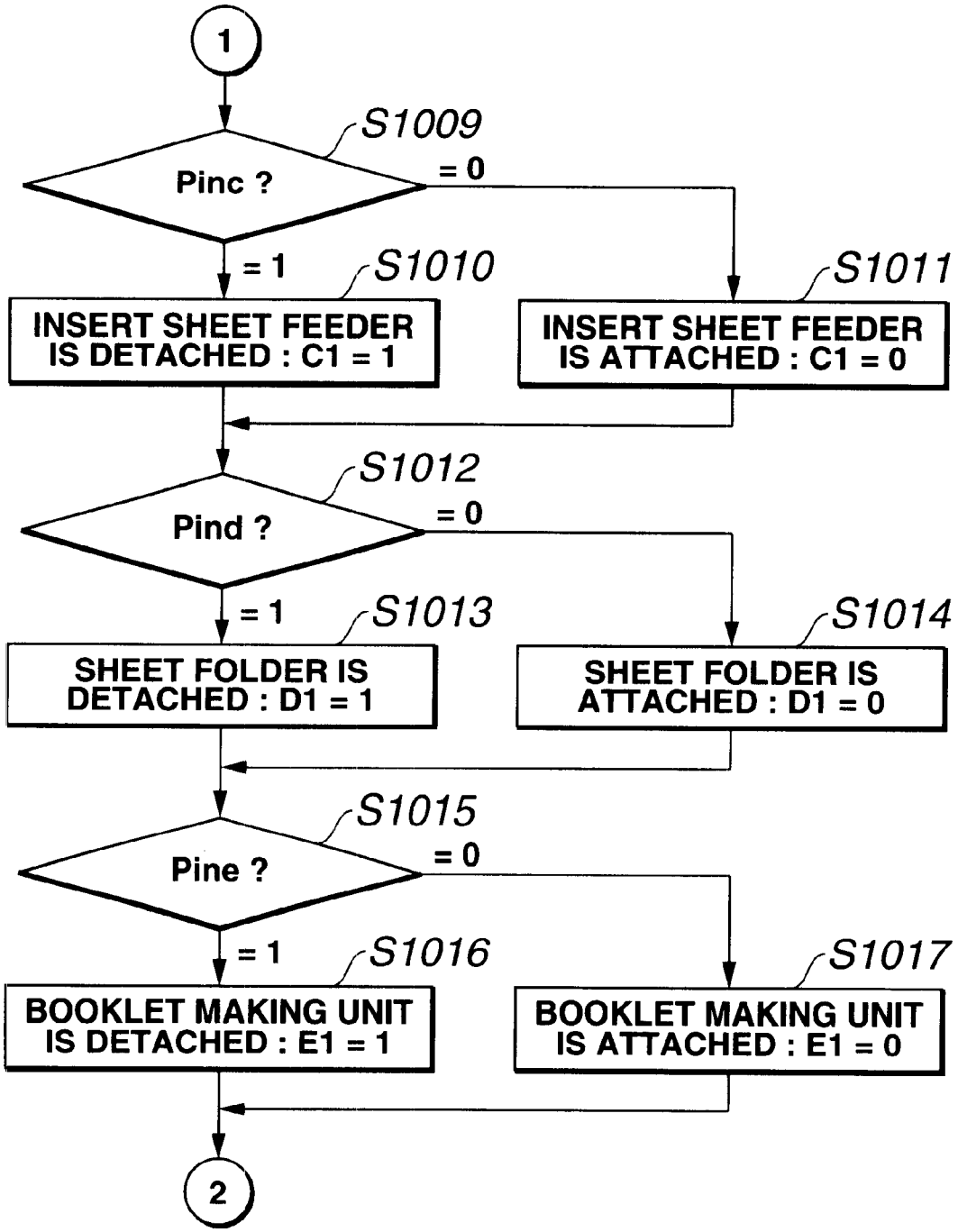

FIGS. 18 and 19 show a flowchart for detecting if each unit is attached to finisher 500. In this flowchart, a high level is represented by "1" and a low level is represented by "0". CPU 2009 sets Pout of CPU 2009 to a high level (S1001). After waiting for 100 ms (S1002), CPU 2009 discriminates Pina (S1003). If Pina is a high level, CPU 2009 discriminates that stack tray unit 701 is detached, and sets variable Al to "1" (S1004). If Pina is a low level, CPU 2009 discriminates that stack tray unit 701 is attached, and sets variable A1 to "0" (S1005).

Then, CPU 2009 discriminates Pinb (S1006). If Pinb is a high level, CPU 2009 discriminates that sheet punching unit 550 is detached, and sets variable B1 to "1" (S1007). If Pinb is a low level, CPU 2009 discriminates that sheet punching unit 550 is attached, and sets variable B1 to "0" (S1008). Then, CPU 2009 discriminates Pinc (S1009). If Pinc is a high level, CPU 2009 discriminates that insert sheet feeder 900 is detached, and sets variable C1 to "1" (S1010). If Pinc is a low level, CPU 2009 discriminates that insert sheet feeder 900 is attached, and sets variable C1 to "0" (S1011).

Then, CPU 2009 discriminates Pind (S1012). If Pind is a high level, CPU 2009 discriminates that sheet folder 400 is detached, and sets variable D1 to "1" (S1013). If Pind is a low level, CPU 2009 discriminates that sheet folder 400 is attached, and sets variable D1 to "0" (S1014). Then, CPU 2009 discriminates Pine (S1015). If Pine is a high level, CPU 2009 discriminates that booklet making unit 800 is detached, and sets variable El to "1" (S1016). If Pine is a low level, CPU 2009 discriminates that booklet making unit 800 is attached, and sets variable E1 to "0" (S1017).

Figure 20:
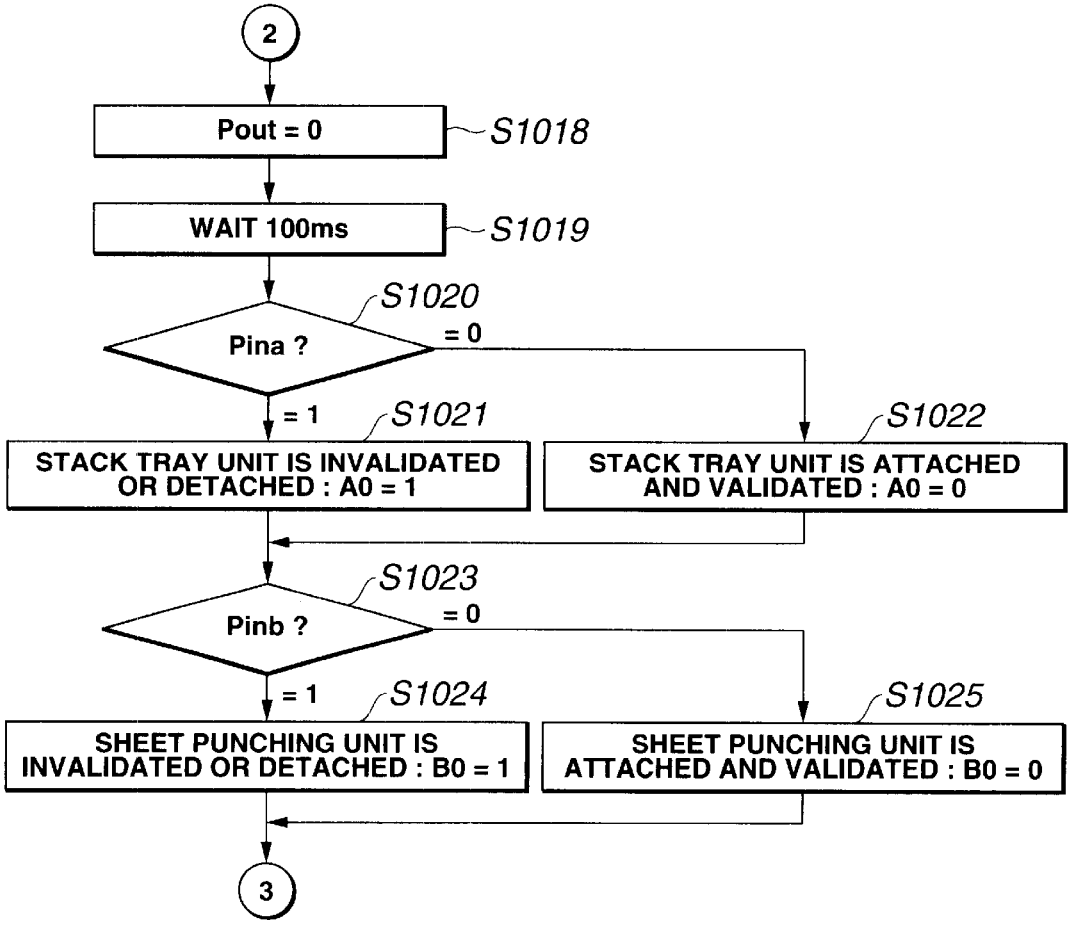
FIGS. 20 and 21 show a flowchart for detecting if each unit of the finisher is validated.
Figure 21:
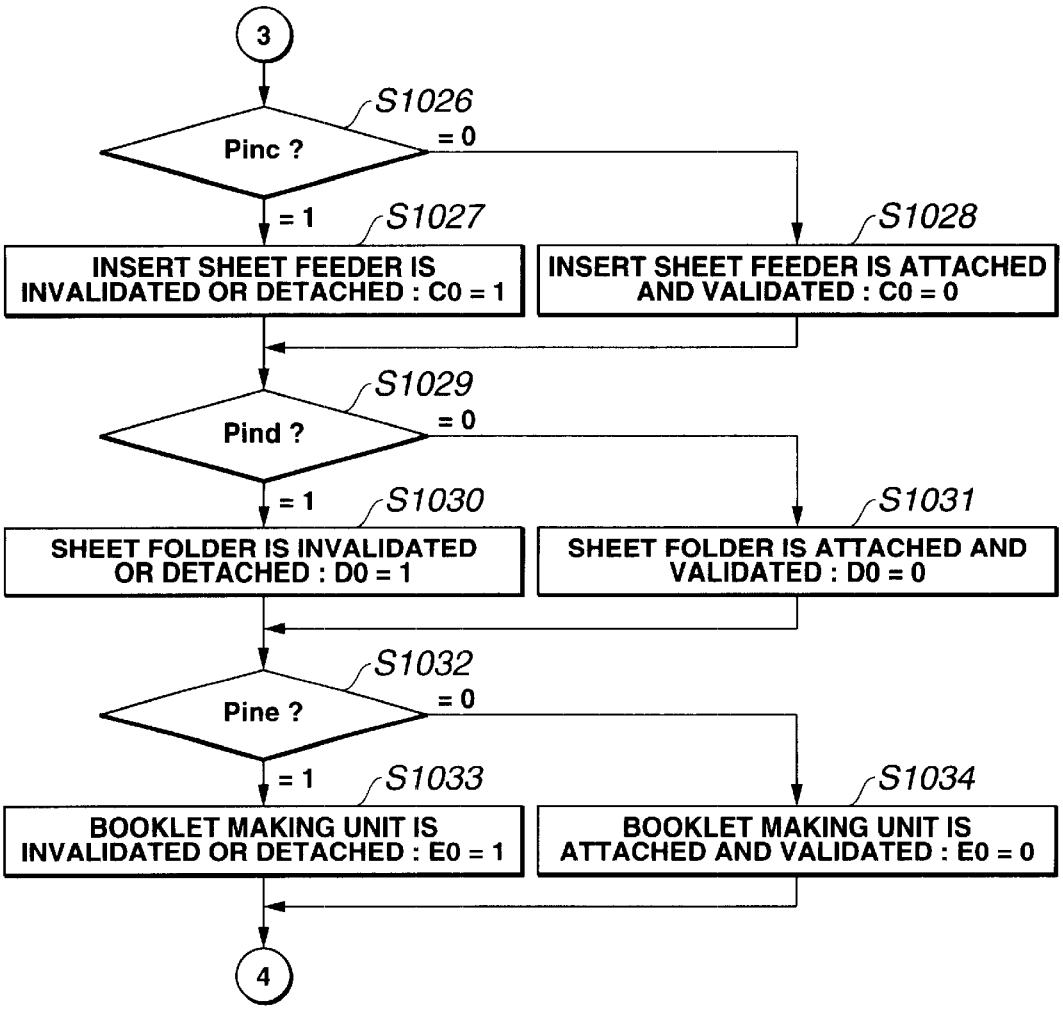

FIGS. 20 and 21 show a flowchart for detecting if each unit of finisher 500 is validated. In this flowchart, a high level is represented by "1" and a low level is represented by "0". CPU 2009 sets Pout of CPU 2009 to a low level (S1018). After waiting for 100 ms (S1019), CPU 2009 discriminates Pina (S1020). If Pina is a high level, CPU 2009 discriminates that stack tray unit 701 is invalidated or detached, and sets variable A0 to "1" (S1021). if Pina is a low level, CPU 2009 discriminates that stack tray unit 701 is attached and validated, and sets variable A0 to "0" (S1022).

Then, CPU 2009 discriminates Pinb (S1023). If Pinb is a high level, CPU 2009 discriminates that sheet punching unit 550 is invalidated or detached, and sets variable B0 to "1" (S1024). If Pinb is a low level, CPU 2009 discriminates that sheet punching unit 550 is attached and validated, and sets variable B0 to "0" (S1025). Then, CPU 2009 discriminates Pinc (S1026). If Pinc is a high level, CPU 2009 discriminates that insert sheet feeder 900 is invalidated or detached, and sets variable C0 to "1" (S1027). If Pinc is a low level, CPU 2009 discriminates that insert sheet feeder 900 is attached and validated, and sets variable C0 to "0" (S1028).

Then, CPU 2009 discriminates Pind (S1029). If Pind is a high level, CPU 2009 discriminates that sheet folder 400 is invalidated or detached, and sets variable D0 to "1" (S1030). If Pind is a low level, CPU 2009 discriminates that sheet folder 400 is attached and validated, and sets variable D0 to "0" (S1031). Then, CPU 2009 discriminates Pine (S1032). If Pine is a high level, CPU 2009 discriminates that booklet making unit 800 is invalidated or detached, and sets variable E0 to "1" (S1033). If Pine is a low level, CPU 2009 discriminates that booklet making unit 800 is attached and validated, and sets variable E0 to "0" (S1034).

Figure 22:
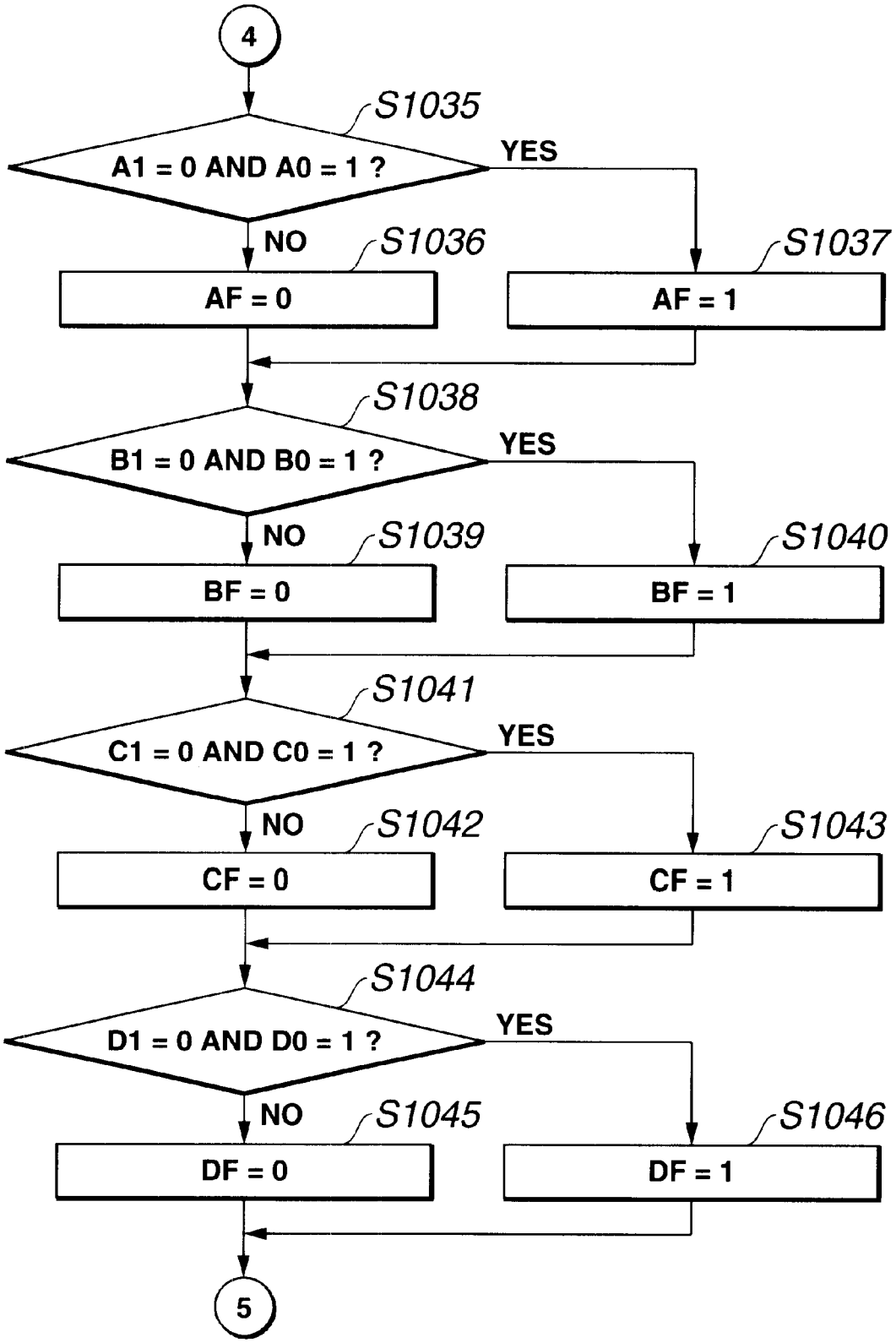
FIGS. 22 and 23 show a flowchart for deciding if a warning screen is displayed.
Figure 23:
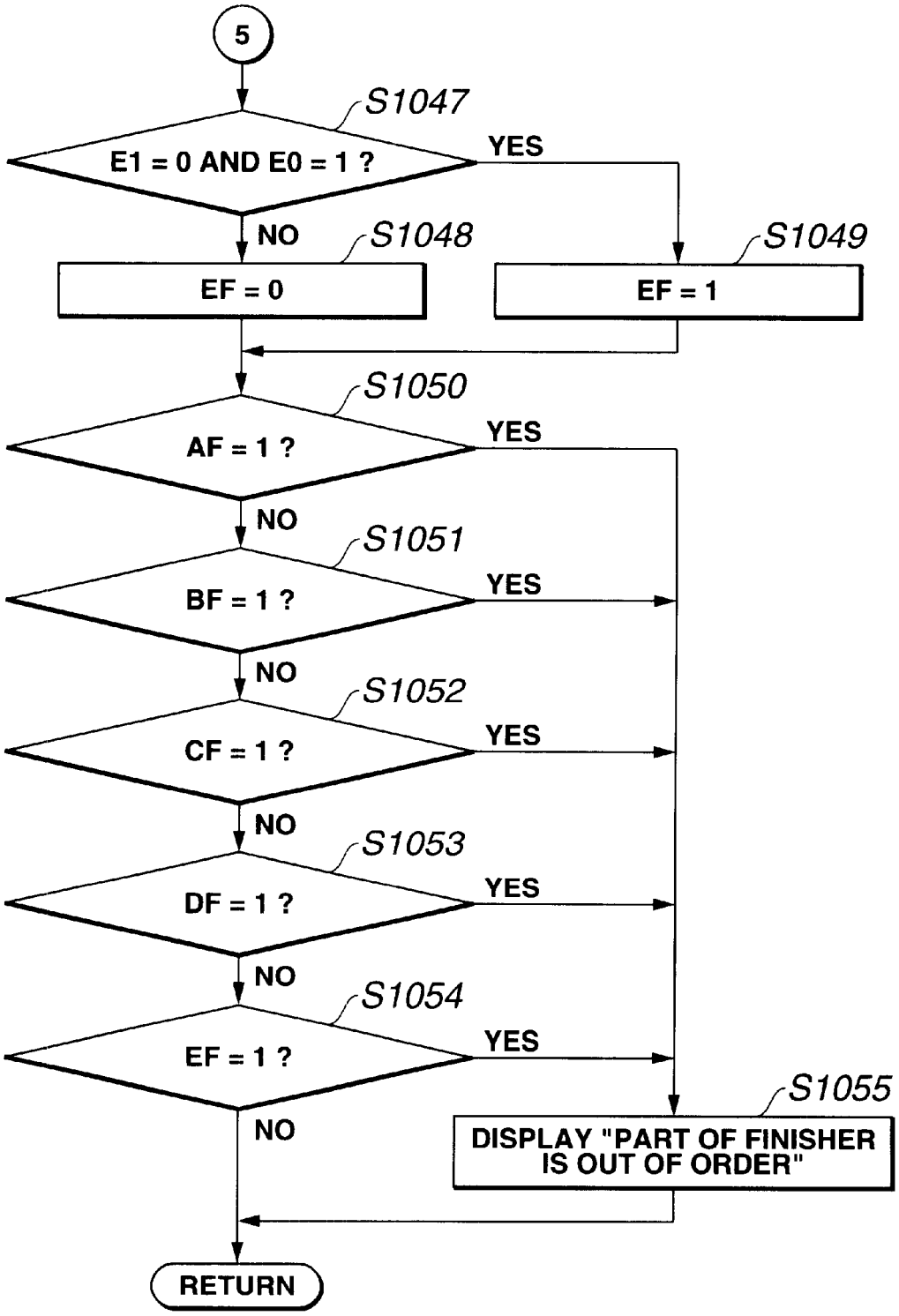

FIGS. 22 and 23 show a flowchart for deciding if warning screen B is displayed. CPU 2009 discriminates if A1=0 and A0=1 (S1035). If A1=0 and A0=1, CPU 2009 sets variable AF to "1" (S1037). If not, CPU 2009 sets variable AF to "0" (S1036).

CPU 2009 discriminates if B1=0 and B0=1 (S1038). If B1=0 and B0=1, CPU 2009 sets variable BF to "1" (S1040). If not, CPU 2009 sets variable BF to "0" (S1039). CPU 2009 discriminates if C1=0 and C0=1 (S1041). If C1=0 and C0=1, CPU 2009 sets variable CF to "1" (S1043). If not, CPU 2009 sets variable CF TO "0" (S1042).

CPU 2009 discriminates if D1=0 and D0=1 (S1044) If D1=0 and D0=1, CPU 2009 sets variable DF to "1" (S1046). If not, CPU 2009 sets variable DF to "0" (S1045). CPU 2009 discriminates if E1=0 and E0=1 (S1047). If E1=0 and F0=1, CPU 2009 sets variable EF to "1" (S1049). If not, CPU 2009 sets variable EF to "0" (S1048).

Then, CPU 2009 discriminates if at least one of variables AF, BF, CF, DE and EF is 1 (S1050–S1054). If at least one of them is 1, CPU 2009 informs CPU 153 that one of the units is invalidated, and transmits variables AF, BF, CF, DF and EF to CPU 153. CPU 153 of CPU circuit unit 150 instructs operation panel 1 to display a message "Part of finisher is out of order" at the bottom of the display of operation panel 1 as shown in FIG. 14 (S1055).

Figure 24:
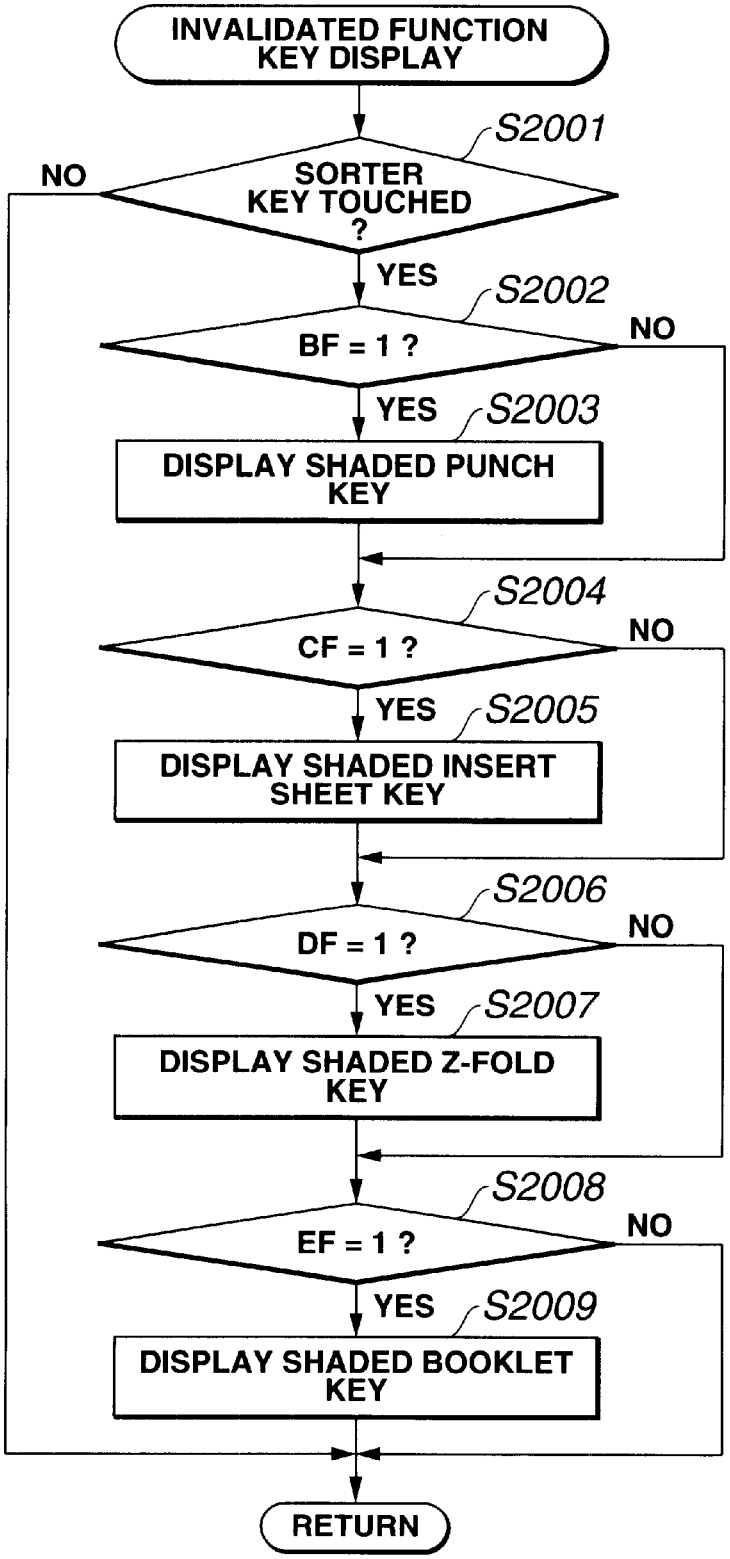
FIG. 24 shows a flowchart for controlling the display screen of the operation panel.

FIG. 24 shows a flowchart for controlling the display screen of operation panel 1. CPU 153 discriminates if the sorter key on the display of operation panel 1 as shown in FIG. 14 is touched (S2001). If the sorter key is touched, CPU 2009 discriminates if variable BF is 1 (S2002). If BF is 1, CPU 153 instructs operation panel 1 to change the sheet punching select key on the display into a shaded key from a non-shaded key (S2003). After step S2003 or if BF is not 1 at step S2002, CPU 153 discriminates if variable CF is 1 (S2004). If CF is 1, CPU 153 instructs operation panel 1 to change the insert sheet feeding select key on the display into a shaded key from a non-shaded key (S2005).

After step S2005 or if CF is not 1 at step S2004, CPU 153 discriminates if variable DF is 1 (S2006). If DF is 1, CPU 153 instructs operation panel 1 to change the sheet folding select key on the display into a shaded key from a nonshaded key (S2007). After step S2007 or if DF is not 1 at step S2006, CPU 153 discriminates if variable EF is 1 (S2008). If EF is 1, CPU 153 instructs operation panel 1 to change the booklet making select key on the display into a shaded key from a nonshaded key (S2009).

Figure 25:
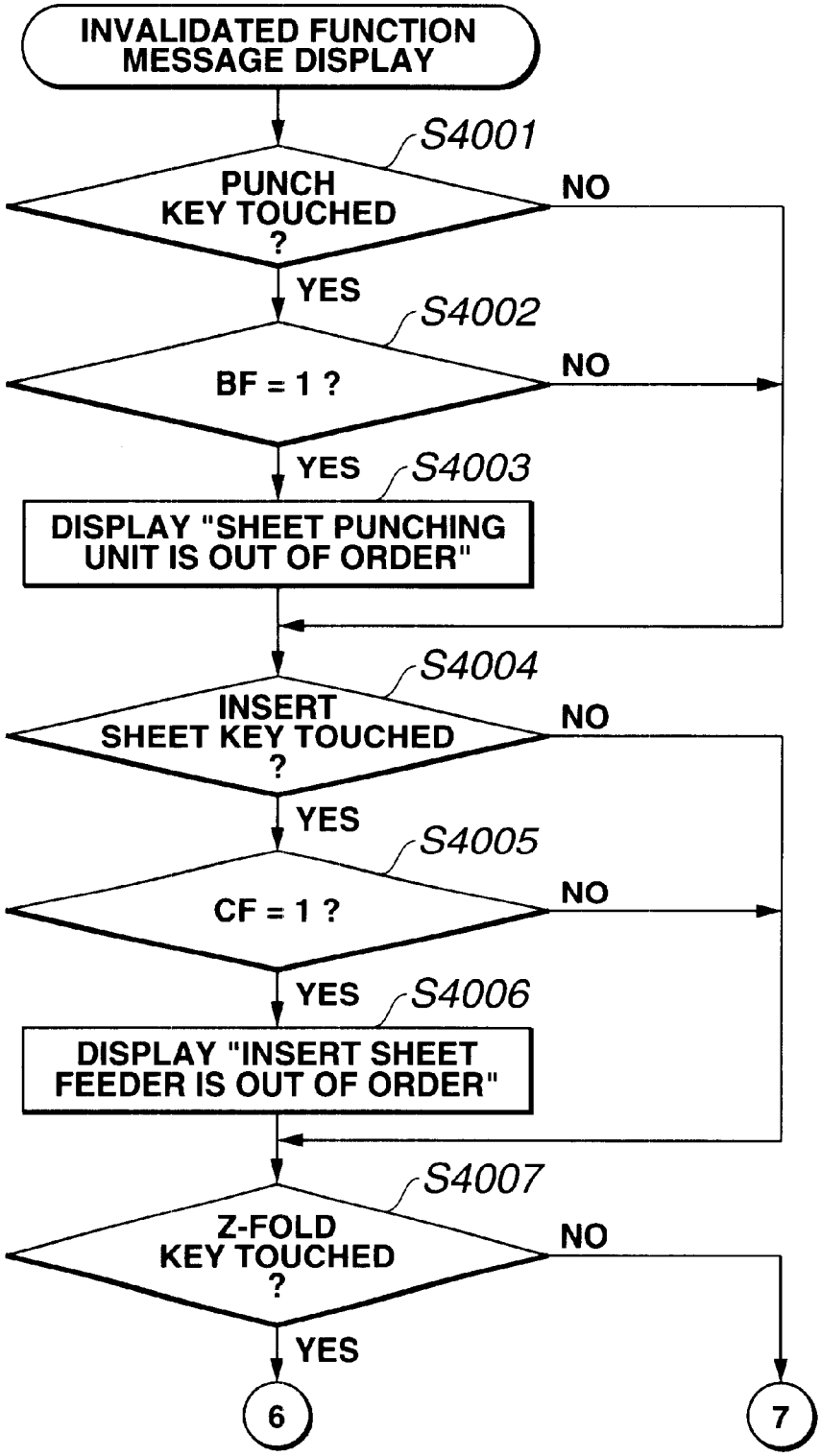
FIGS. 25 and 26 show a flowchart for displaying an invalidated function message.
Figure 26:
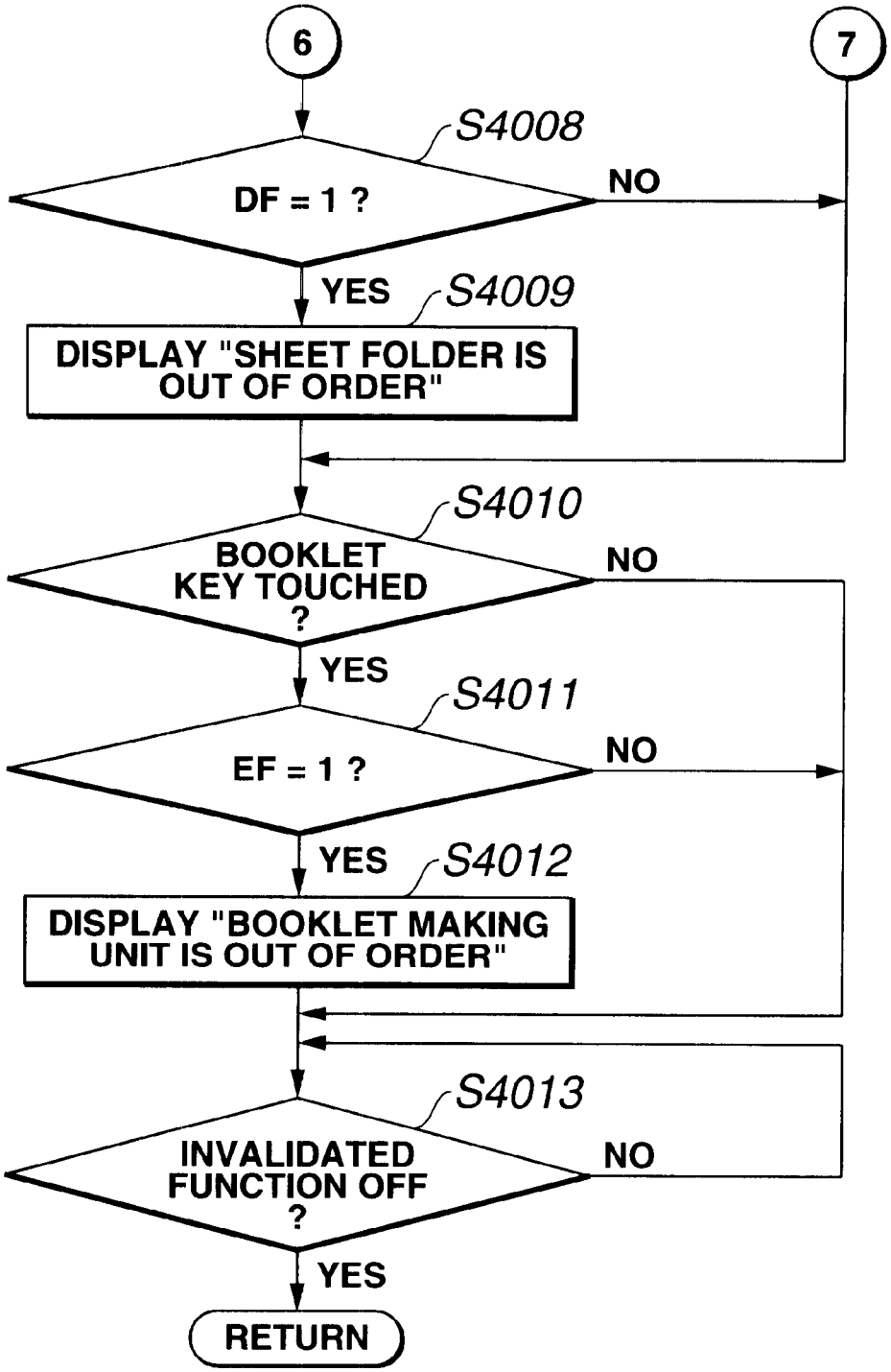

FIGS. 25 and 26 show a flowchart for displaying an invalidated function message. CPU 153 discriminates if the sheet punching select key is touched (S4001). If the sheet punching select key is touched, CPU 153 discriminates if variable BF is 1 (S4002). If BF is 1, CPU 153 instructs operation panel 1 to display a message "sheet punching unit is out of order" at the bottom of the display (S4003). After step S4003 or if the sheet punching select key is not touched at step S4001, CPU 153 discriminates if the insert sheet feeding select key is touched (S4004). If the insert sheet feeding select key is touched, CPU 153 discriminates if variable CF is 1 (S4005). If CF is 1, CPU 153 instructs operation panel 1 to display a message "insert sheet feeder is out of order" at the bottom of the display (S4006).

After step S4006 or if the insert sheet feeding select key is not touched at step S4004, CPU 153 discriminates if the sheet folding select key is touched (S4007). If the sheet folding select key is touched, CPU 153 discriminates if variable DF is 1 (S4008). If DF is 1, CPU 153 instructs operation panel 1 to display a message "sheet folder is out of order" at the bottom of the display (S4009). After step S4009 or if the sheet folding select key is not touched at step S4007, CPU 153 discriminates if the booklet making select key is touched (S4010). If the booklet making select key is touched, CPU 153 discriminates if variable EF is 1 (S4011). If EF is 1, CPU 153 instructs operation panel 1 to display a message "booklet making unit is out of order" at the bottom of the display (S4012).

After step S4012 or if the booklet making select key is not touched at step S4010, CPU 153 confirms if the invalidated function key is OFF (S4013).

CPU 153 transmits variables AF, BF, CF, DF and EF to computer 210 through external I/F 209. Computer 210 displays the same message as the one displayed on operation panel 1. Thereby, a user can avoid designating a function which is out of order when print data is transmitted from computer 210 to image forming apparatus 1000.

Figure 27:
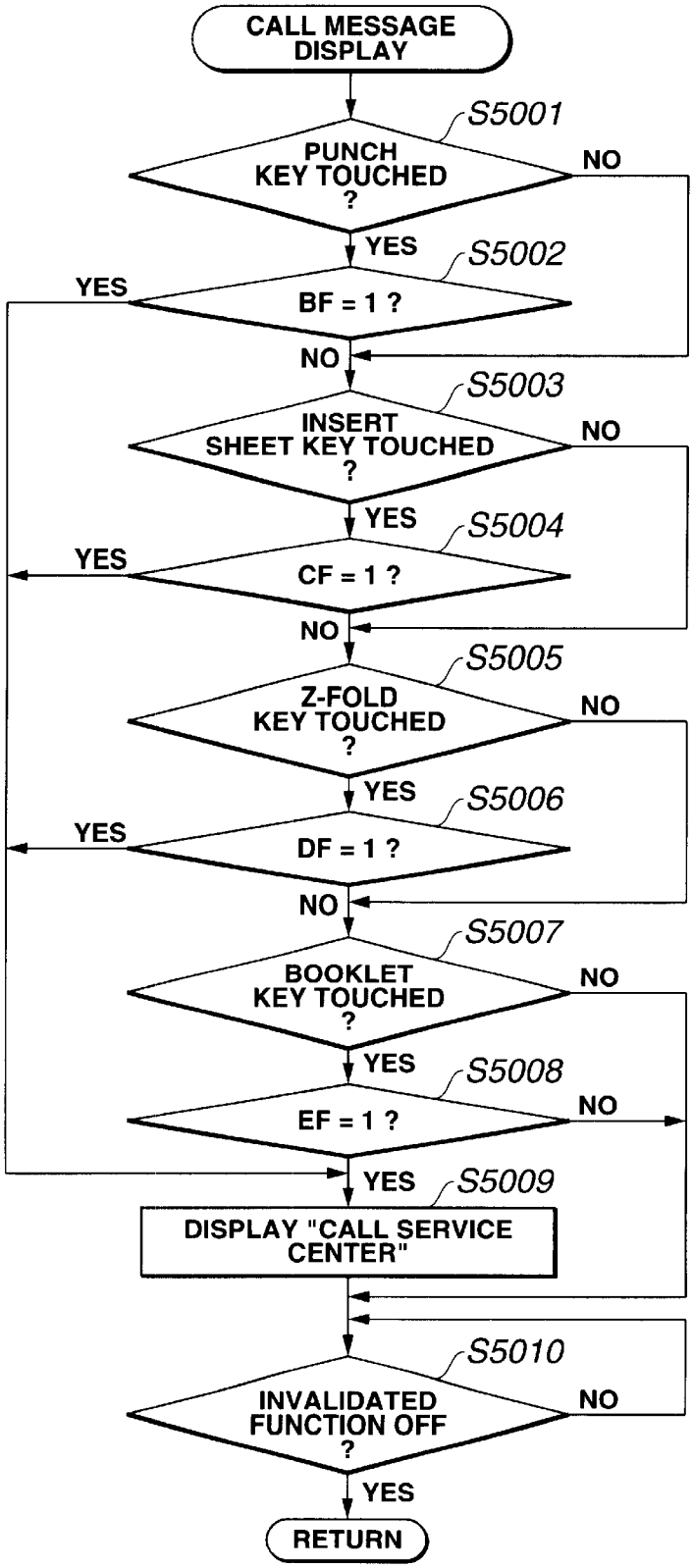
FIG. 27 shows a flowchart for displaying a message to call a service center.
Figure 29:
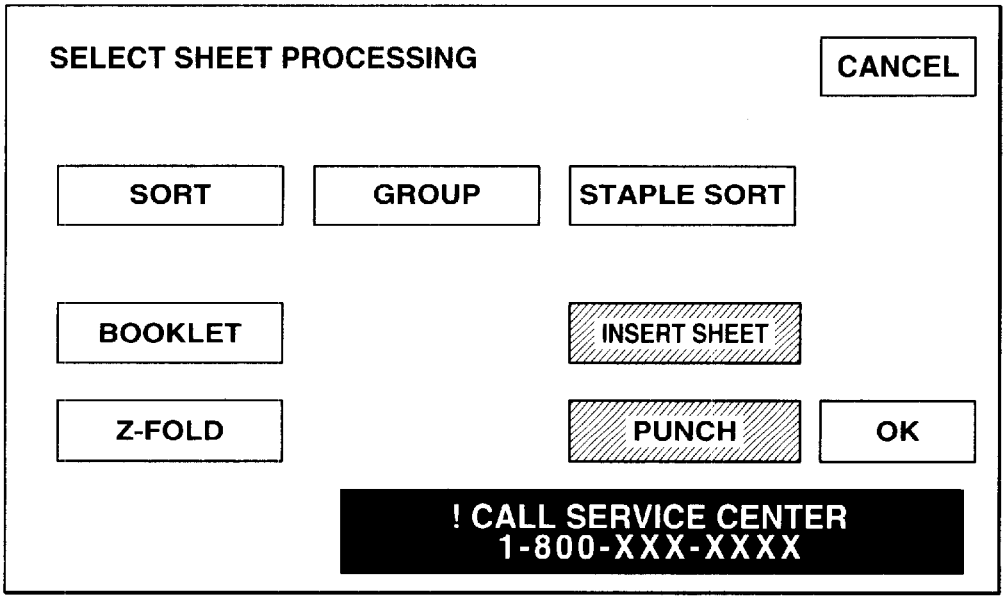
FIGS. 29 and 30 show display screens for selecting sheet processing.

FIG. 27 shows a flowchart for displaying a message in a case where image forming apparatus 1000 does not connect to computer 210 or computer 210 cannot connect to service center 250. CPU 153 discriminates if the sheet punching select key is touched (S5001). If the sheet punching select key is touched, CPU 153 discriminates if variable BF is 1 (S5002). Tf BF is 1, CPU 153 instructs operation panel 1 to display a message "call service center 1-800-XXX-XXXX" at the bottom of the display as shown in FIG. 29 (S5009). If BF is not 1 at step S5002 or if the sheet punching select key is not touched at step S5001, CPU 153 discriminates if the insert sheet feeding select key is touched (S5003). If the insert sheet feeding select key is touched, CPU 153 discriminates if variable CF is 1 (S5004). If CF is 1, CPU 153 proceeds to step S5009.

If CF is not 1 at step S5004 or if the insert sheet feeding select key is not touched at step S5003, CPU 153 discriminates if the sheet folding select key is touched (S5005). If the sheet folding select key is touched, CPU 153 discriminates if variable DF is 1, (S5006). If DF is 1, CPU 153 proceeds to step S5009. If DF is not 1 at step S5006 or if the sheet folding select key is not touched at step S5005, CPU 153 discriminates if the booklet making select key is touched (S5007). If the booklet making select key is touched, CPU 153 discriminates if variable EF is 1 (S5008). If EF is 1, CPU 153 proceeds to step S5009.

After step S5009 or if the booklet making select key is not touched at step S5007, CPU 153 confirms if the invalidated function key is OFF (S5010).

CPU 153 controls operation panel 1 to display the message of step S5009 and the messages shown by FIG. 25 alternately.

Figure 28:
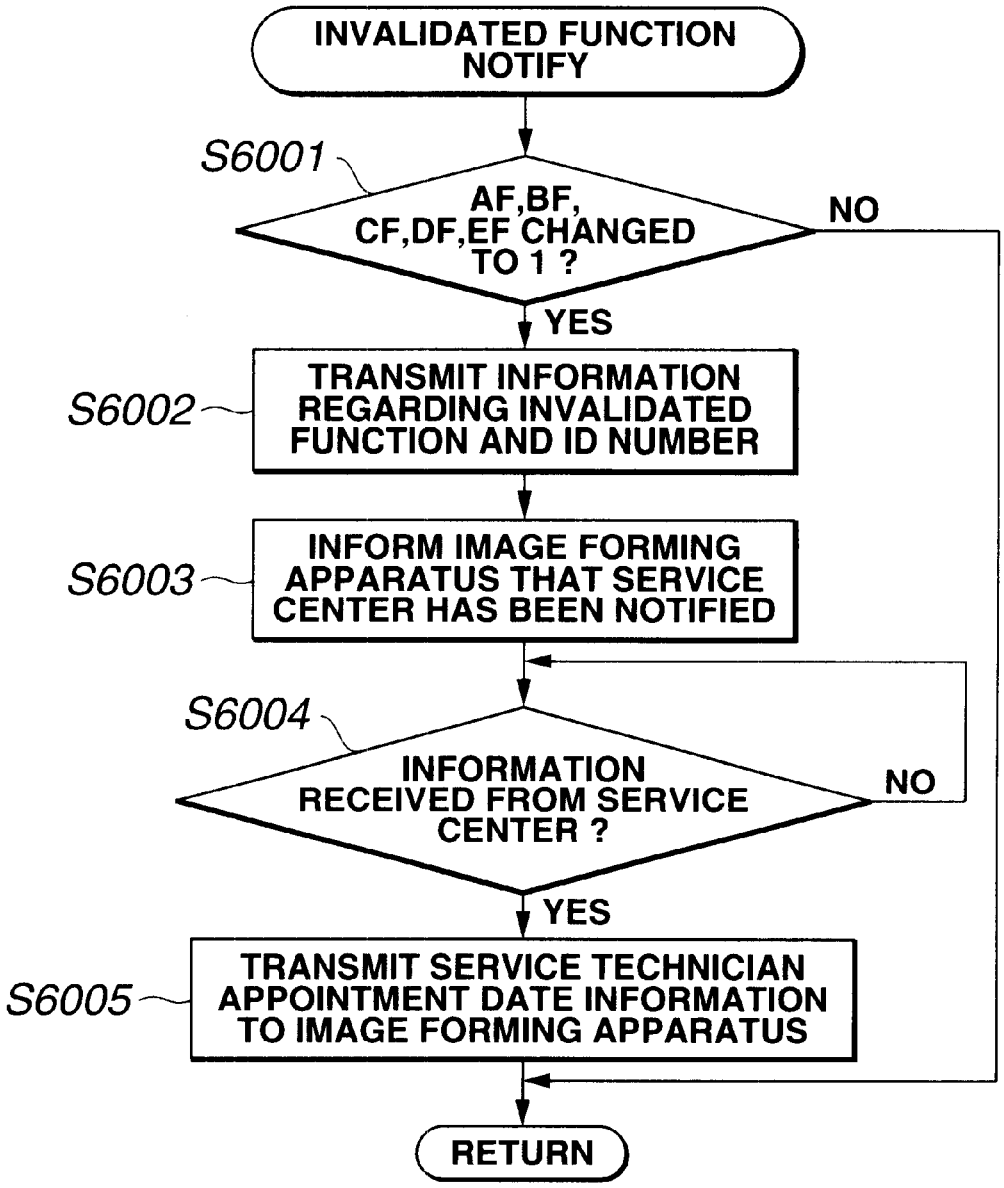
FIG. 28 shows a flowchart for notifying the service center of an invalidated function.

FIG. 28 shows a flowchart for notifying service center 250 of the invalidated function by computer 210. A program of this flowchart is installed to a hard disc of computer 210 from a CD-ROM or a floppy disc and executed by computer 210.

Figure 30:
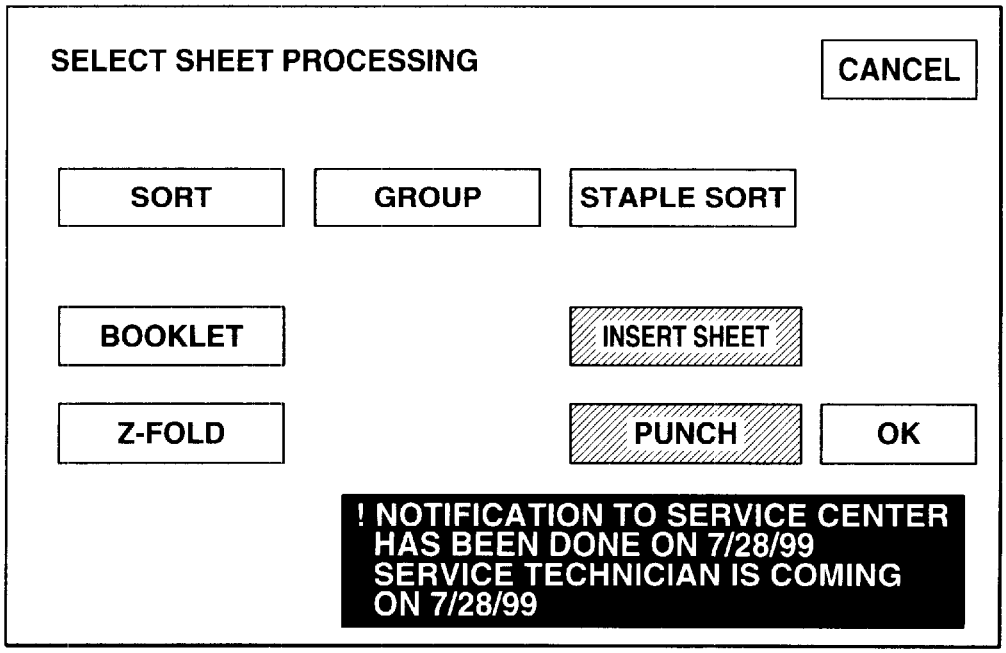

Computer 210 monitors variables AF, BF, CF, DF and EF received from CPU 153 and discriminates if there is a change with the variables (S6001). If at least one of variables AF, BF, CF, DF and EF is changed to 1, computer 210 connects to service center 250 through modem 211 and transmits information regarding an invalidated function according to variables AF, BF, CF, DF and EF and an identification number of image forming apparatus 1000 to service center 250 (S6002). Then, computer 210 informs CPU 153 that service center 250 has been notified (S6003). CPU 153 instructs operation panel 1 to display a message "notification to service center has been done on ##/##/##". Computer 210 monitors a response from service center 250 (S6004). Service center 250 transmits information including when a service technician is coming. If the information is received from service center 250, computer 210 transmits the received information to CPU 153 (S6005). CPU 153 instructs operation panel 1 to display a message "service technician is coming on ##/##/##" as shown in FIG. 30.

It is to be understood that the phraseology or terminology employed herein in for the purpose of description and not of limitation.

While the invention has been described with reference to the structures disclosed herein, it is not confined to the details set forth and this application is intended to cover such modifications or changes as may come within the purposes of the improvements or the scope of the following claims.

What is claimed is:

1. A sheet processing apparatus for processing sheets from an image forming apparatus comprising:

a first processing unit for processing a sheet, said first processing unit including a processing station for processing a sheet, a first path for transporting a sheet therethrough, and a second path for transporting a sheet to said processing station;

a second processing unit for processing the sheet transported from said first processing unit;

a power supply for supplying power independently to said first processing unit and said second processing unit;

wherein said first processing unit selects said first path when said first processing unit is not supplied with power by said power supply.

2. A sheet processing apparatus according to claim 1, wherein said first processing unit includes leading means for leading a sheet to one of said first and second paths alternatively, and said leading means leads a sheet to said first path when said first processing unit is not supplied with the power by said power supplier.

3. A sheet processing apparatus according to claim 2, wherein said processing unit includes driving means for driving said leading means to select said second path, wherein said driving means is not supplied with the power when said first processing unit is not supplied with the power by said power supplier.

4. A sheet processing apparatus according to claim 3, wherein said leading means is driven by said driving means so that said leading means selects said second path, wherein said leading means is pulled by elastic means so that said leading means selects said first path.

5. A sheet processing apparatus according to claim 4, wherein said leading means is a flapper, and said driving means is a solenoid, and said elastic means is a spring.

6. A sheet processing apparatus according to claim 1, further comprising an invalidation terminal for designating which unit is not supplied with power, wherein said power supply supplies power in accordance with a designation at said invalidation terminal.

7. A sheet processing apparatus according to claim 6, wherein said invalidation terminal includes first and second switches corresponding to said first and second processing units respectively, said first and second switches are grounded and are connected to first and second resistors respectively which are connected to a power source, wherein said power supply includes a first voltage detector for detecting a voltage between said first or second switch and its respective resistor, and wherein said power supply supplies power when a voltage detected by said first voltage detector is a predetermined voltage.

8. A sheet processing apparatus according to claim 7, further comprising a unit attachment detector for detecting an attachment state of said first and second processing units which are detachable from said sheet processing apparatus, wherein said first or second switches is connected to its respective resistor through a connector when said first or second unit is attached, and is disconnected from its respective resistor when said first or second unit is detached, wherein said unit attachment detector includes a second voltage detector for detecting a voltage between said first or second resistor and said connector, wherein said unit attachment detector includes a third switch which is grounded and connected to a third resistor which is connected to a point between said first or second switches and said connector, and wherein said unit attachment detector turns said third switch on and detects the attachment state based on a voltage by detected said second voltage detector.

9. A sheet processing apparatus according to claim 1, wherein said first processing unit comprises a sheet folder for folding a sheet.

10. A sheet processing apparatus according to claim 1, further comprising a display for displaying an indication when at least one of said first and second processing unit is not supplied with power.

11. A sheet processing apparatus according to claim 1, further comprising a transmitter for transmitting a notification to a service center when at least one of said first and second processing unit is not supplied with power.

12. A controlling method of a sheet processing apparatus for processing sheets from an image forming apparatus, said sheet processing apparatus including a first processing unit for processing a sheet, said first processing unit including a processing station for processing a sheet, a first path for transporting a sheet therethrough, and a second path for transporting a sheet to said processing station, and a second processing unit for processing the sheet transported from said first processing unit, said controlling method comprising:

a step for supplying power independently to said first processing unit and said second processing unit; and a step for selecting said first path when said first processing unit is not supplied with power by said power supply.

* * * * *

UNITED STATES PATENT AND TRADEMARK OFFICE

CERTIFICATE OF CORRECTION

PATENT NO. : 6,371,471 B1
DATED : April 16, 2002
INVENTOR(S) : Yasuo Fukazu et al.

It is certified that error appears in the above-identified patent and that said Letters Patent is hereby corrected as shown below:

Title page, Item [54] and Column 1, line 2,
Title, "UNIT" should read -- UNITS --.
Item [57], ABSTRACT,
Line 2, "unit for" should read -- unit --; and
Line 3, "processing a sheet, the first processing unit including" should read -- including --.

Column 3,
Line 31, "the to" should read -- to the --.

Column 6,
Line 57, "VH>ES1>VM>V1." should read -- VH>ES1>VM>VL --.

Column 11,
Line 34, "F0=1," should read -- E0=1, --.

Column 14,
Line 7, "includes¶" should read -- includes --;
Line 37, "by detected" should read -- detected by --;
Line 43, "unit" should read -- units --; and
Line 48, "unit" should read -- units --.

Signed and Sealed this

Twenty-third Day of July, 2002

*Attest:*

*Attesting Officer*

JAMES E. ROGAN
*Director of the United States Patent and Trademark Office*